US011602255B2

(12) United States Patent
Buehler et al.

(10) Patent No.: US 11,602,255 B2
(45) Date of Patent: Mar. 14, 2023

(54) SUPPLY AND/OR DISPOSAL SYSTEM FOR AUTONOMOUS FLOOR CLEANER

(71) Applicant: BISSELL Inc., Grand Rapids, MI (US)

(72) Inventors: Eric Daniel Buehler, Grand Rapids, MI (US); Jeffrey A. Scholten, Grand Rapids, MI (US); Adam Brown, Holland, MI (US)

(73) Assignee: BISSELL Inc., Grand Rapids, MI (US)

( * ) Notice: Subject to any disclaimer, the term of this patent is extended or adjusted under 35 U.S.C. 154(b) by 0 days.

(21) Appl. No.: 17/548,895

(22) Filed: Dec. 13, 2021

(65) Prior Publication Data

US 2022/0095874 A1 Mar. 31, 2022

Related U.S. Application Data

(63) Continuation of application No. 16/922,615, filed on Jul. 7, 2020, now Pat. No. 11,224,326, which is a continuation of application No. 16/018,345, filed on Jun. 26, 2018, now Pat. No. 10,709,308.

(60) Provisional application No. 62/525,383, filed on Jun. 27, 2017.

(51) Int. Cl.

| | |
|---|---|
| ***A47L 11/40*** | (2006.01) |
| ***A47L 11/24*** | (2006.01) |
| ***A47L 11/28*** | (2006.01) |

(52) U.S. Cl.

CPC ..... *A47L 11/4088* (2013.01); *A47L 11/24* (2013.01); *A47L 11/28* (2013.01); *A47L 11/4011* (2013.01); *A47L 11/4016* (2013.01); *A47L 11/4025* (2013.01); *A47L 11/4083* (2013.01); *A47L 2201/024* (2013.01); *A47L 2201/026* (2013.01)

(58) Field of Classification Search

CPC ..... B65G 65/42; B65B 1/06; B65B 1/30
USPC ..... 141/311 R
See application file for complete search history.

(56) References Cited

U.S. PATENT DOCUMENTS

| | | | | |
|---|---|---|---|---|
| 3,869,749 | A * | 3/1975 | London | B66B 31/003 15/88.4 |
| 7,053,578 | B2 | 5/2006 | Diehl | |
| 7,389,156 | B2 | 6/2008 | Ziegler | |
| 7,418,762 | B2 | 9/2008 | Arai | |
| 7,620,476 | B2 | 11/2009 | Morse | |
| 7,761,954 | B2 | 7/2010 | Ziegler | |
| 7,891,387 | B2 | 2/2011 | Lim | |
| 8,382,906 | B2 | 2/2013 | Konandreas | |

(Continued)

FOREIGN PATENT DOCUMENTS

| | | |
|---|---|---|
| CN | 1751650 A | 3/2006 |
| CN | 1927549 A | 3/2007 |

(Continued)

OTHER PUBLICATIONS

EP Search Report for EP18178984.3, dated Nov. 29, 2018.

(Continued)

*Primary Examiner* — Jessica Cahill
*Assistant Examiner* — Christopher M Afful
(74) *Attorney, Agent, or Firm* — Quinn IP Law

(57) ABSTRACT

A system for refilling, emptying and/or recharging of an autonomous floor cleaner includes a docking station adapted to be coupled with a household plumbing infrastructure. The docking station can be provided on a household appliance, which may be a toilet, a dishwasher, or another appliance coupled with the plumbing infrastructure.

18 Claims, 17 Drawing Sheets

(56) References Cited

U.S. PATENT DOCUMENTS

| | | | | |
|---|---|---|---|---|
| 8,387,193 | B2 | 3/2013 | Ziegler | |
| 8,392,021 | B2 | 3/2013 | Konandreas | |
| 8,670,866 | B2 | 3/2014 | Ziegler | |
| 8,739,355 | B2 | 6/2014 | Morse | |
| 8,774,966 | B2 | 7/2014 | Ziegler | |
| 8,774,970 | B2 | 7/2014 | Knopow | |
| 8,782,848 | B2 | 7/2014 | Ziegler | |
| 8,855,813 | B2 | 10/2014 | Ziegler | |
| 8,966,707 | B2 | 3/2015 | Morse | |
| 8,985,127 | B2 | 3/2015 | Konandreas | |
| 9,445,702 | B2 | 9/2016 | Ziegler | |
| 9,687,131 | B2 | 6/2017 | Eidmohammadi | |
| 9,706,891 | B2 | 7/2017 | Ziegler | |
| 11,000,170 | B2 * | 5/2021 | Blumhardt | A47L 11/145 |
| 2006/0288518 | A1 * | 12/2006 | Lenkiwicz | A47L 11/4016 15/322 |
| 2007/0061040 | A1 | 3/2007 | Augenbraun | |
| 2008/0127446 | A1 | 6/2008 | Ziegler | |
| 2008/0140255 | A1 | 6/2008 | Ziegler | |
| 2013/0145572 | A1 | 6/2013 | Schregardus | |
| 2014/0090201 | A1 | 4/2014 | Gilbert, Jr. | |
| 2015/0289741 | A1 | 10/2015 | Konandreas | |
| 2016/0037983 | A1 | 2/2016 | Hillen | |
| 2016/0331202 | A1 | 11/2016 | Arakawa | |
| 2016/0352112 | A1 * | 12/2016 | Shudo | A47L 11/4013 |
| 2017/0049288 | A1 | 2/2017 | Knutson | |
| 2017/0283092 | A1 | 10/2017 | Brown et al. | |
| 2019/0187717 | A1 | 6/2019 | He et al. | |

FOREIGN PATENT DOCUMENTS

| | | | |
|---|---|---|---|
| CN | 101049218 | A | 10/2007 |
| CN | 104257330 | A | 1/2015 |
| CN | 104808666 | A | 7/2015 |
| CN | 205096032 | U | 3/2016 |
| CN | 105848549 | A | 8/2016 |
| CN | 106235954 | A | 12/2016 |
| CN | 106308685 | A | 1/2017 |
| CN | 106725135 | A | 5/2017 |
| CN | 106859519 | A | 6/2017 |
| CN | 106923755 | A | 7/2017 |
| CN | 109068925 | A | 12/2018 |
| DE | 102014111868 | A1 | 2/2016 |
| DE | 202016104066 | U1 | 12/2017 |
| DE | 202016104067 | U1 | 12/2017 |
| EP | 1243218 | A1 | 9/2002 |
| EP | 1762165 | A2 | 3/2007 |
| EP | 2145573 | A1 | 1/2010 |
| EP | 2279686 | A2 | 2/2011 |
| KR | 200381912 | Y1 | 4/2005 |
| WO | 06089307 | A2 | 8/2006 |
| WO | 2017190785 | A1 | 11/2017 |
| WO | 2017190788 | A1 | 11/2017 |

OTHER PUBLICATIONS

Chinese Patent Office, Office Action re Corresponding Application No. 201810667931.5, dated Dec. 14, 2020, 8 pages, China.

* cited by examiner

SUPPLY AND/OR DISPOSAL SYSTEM FOR AUTONOMOUS FLOOR CLEANER

CROSS-REFERENCE TO RELATED APPLICATION(S)

This application is a continuation of U.S. patent application Ser. No. 16/922,615 filed Jul. 7, 2020, now allowed, which is a continuation of U.S. patent application Ser. No. 16/018,345 filed Jun. 26, 2018, now U.S. Pat. No. 10,709,308, which claims the benefit of U.S. Provisional Patent Application No. 62/525,383, filed Jun. 27, 2017, which are incorporated herein by reference in their entirety.

BACKGROUND

Autonomous or robotic floor cleaners can move without the assistance of a user or operator to clean a floor surface. For example, the floor cleaner can be configured to sweep dirt (including dust, hair, and other debris) into a collection bin carried on the floor cleaner and/or to sweep dirt using a cloth which collects the dirt. The floor cleaner can move randomly about a surface while cleaning the floor surface or use a mapping/navigation system for guided navigation about the surface. Some floor cleaners are further configured to apply and extract liquid for deep cleaning carpets, rugs, and other floor surfaces.

BRIEF DESCRIPTION

An aspect of the present disclosure relates to a system, comprising a docking station for docking an autonomous floor cleaner, the docking station comprising a liquid supply system configured to provide liquid to an autonomous floor cleaner, the liquid supply system comprising a supply conduit, wherein the docking station is configured to be fluidly coupled to a plumbing infrastructure and wherein the liquid supply system is configured to automatically provide liquid to the autonomous floor cleaner.

BRIEF DESCRIPTION OF THE DRAWINGS

The invention will now be described with respect to the drawings in which.

DETAILED DESCRIPTION

The invention relates to autonomous cleaners for deep cleaning floor surfaces, including carpets and rugs. More specifically, the invention relates to systems and methods for refilling (or filling) and emptying autonomous deep cleaners.

Figure 1:
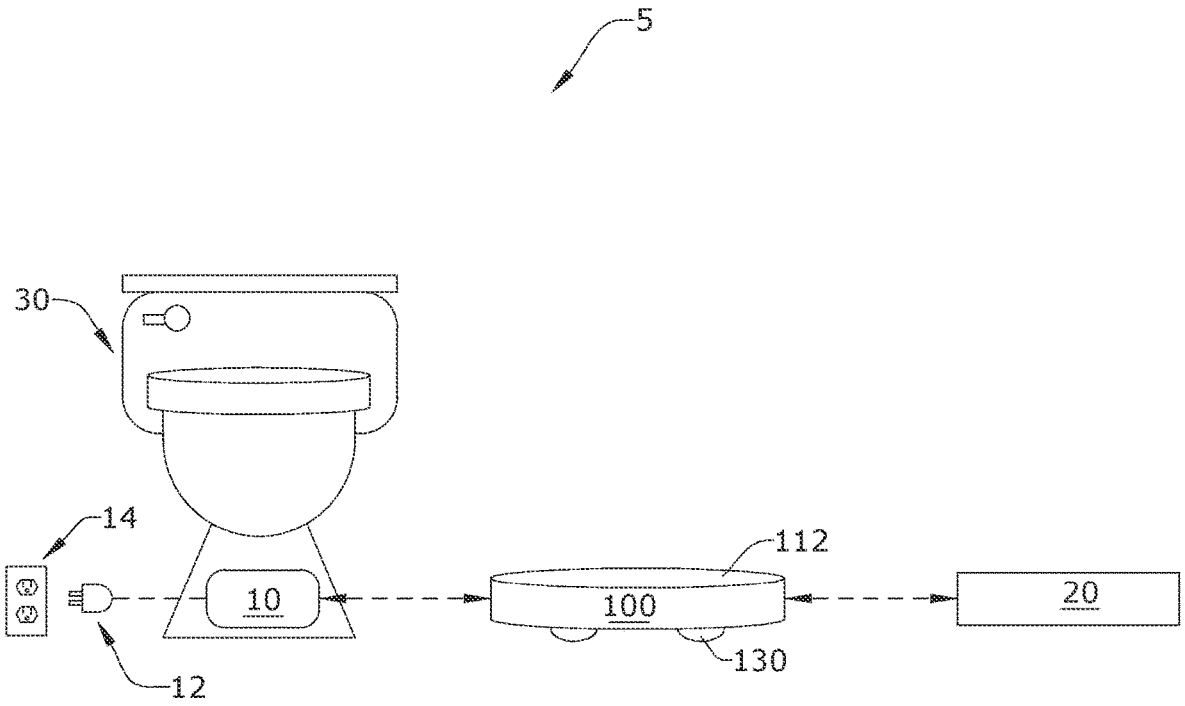
FIG. 1 is a schematic view of a system for supply and disposal for an autonomous floor cleaner, according to one embodiment of the invention.

FIG. 1 is a schematic view of a system 5 for supply and disposal for an autonomous floor cleaner according to one embodiment of the invention. The system 5 for deep cleaning of a floor surface can include an autonomous floor cleaner in the form of a deep cleaning robot 100 and a toilet 30 having a docking station 10 for the robot 100. The deep cleaning robot 100 mounts the components of various functional systems of the deep cleaner in an autonomously moveable unit or housing 112, including at least a fluid delivery system for storing cleaning fluid and delivering the cleaning fluid to the surface to be cleaned, a fluid recovery system for removing the cleaning fluid and debris from the surface to be cleaned and storing the recovered cleaning fluid and debris. The docking station 10 can be configured to automatically fill or refill a solution tank, or supply tank 106 (FIG. 2) of the robot 100 with fresh water and empty a recovery tank 118 (FIG. 2) of the robot 100 via the toilet 30 using existing plumbing infrastructure.

Optionally, an artificial barrier system 20 can also be provided with the system 5 for containing the robot 100 within a user-determined boundary. Also, optionally, the docking station 10 can further be connected to a household power supply, such as a wall outlet 14, and can include a converter 12 for converting the AC voltage into DC voltage for recharging a power supply on-board the robot 100. The docking station 10 can also include a housing 11 having various sensors and emitters for monitoring robot status, enabling auto-docking functionality, communicating with each robot, as well as features for network and/or Bluetooth connectivity.

Figure 2:
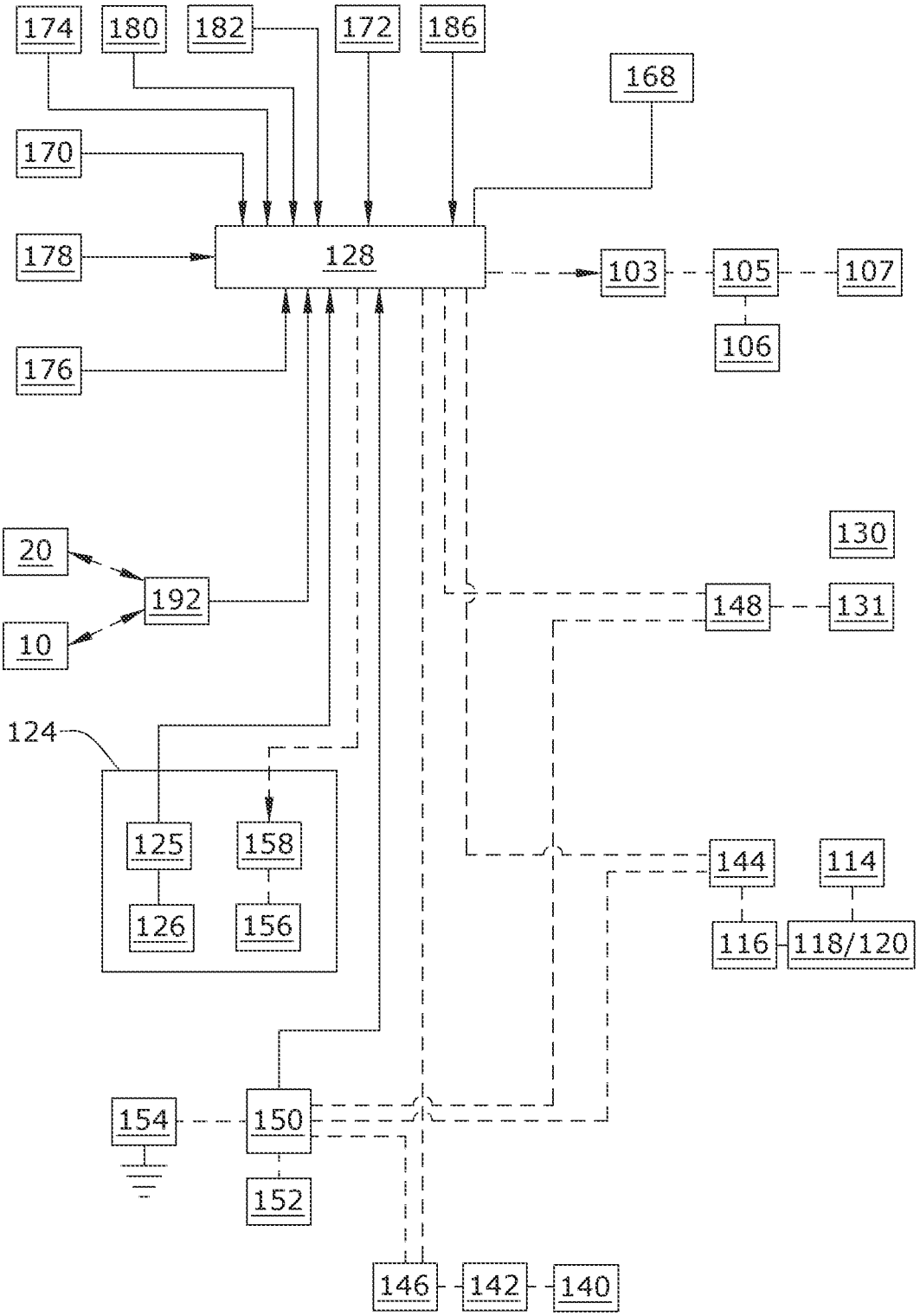
FIG. 2 is a schematic of one embodiment of an autonomous deep cleaner for use in the system of FIG. 1.

FIG. 2 is a schematic view of one embodiment of the autonomous deep cleaner or deep cleaning robot 100 of the system 5 of FIG. 1. It is noted that the robot 100 shown in FIG. 2 is but one example of a deep cleaning robot 100 that is usable with the system 5, and that other autonomous cleaners requiring liquid supply and disposal can be used with the system 5, including, but not limited to autonomous deep cleaners capable of delivering steam, mist, or vapor to the surface to be cleaned.

The deep cleaning robot 100 mounts the components of various functional systems of the extraction cleaner in an autonomously moveable unit or housing 112 (FIG. 1), including at least the components of a fluid delivery system for storing cleaning fluid and delivering the cleaning fluid to the surface to be cleaned, a fluid recovery system for removing the cleaning fluid and debris from the surface to be cleaned and storing the recovered cleaning fluid and debris, and a drive system for autonomously moving the robot 100 over the surface to be cleaned. The deep cleaning robot 100 can be configured to move randomly about a surface while cleaning the floor surface, using input from various sensors to change direction or adjust its course as needed to avoid obstacles, or, as illustrated herein, can include a navigation/mapping system for guiding the movement of the robot 100 over the surface to be cleaned, generating and storing maps of the surface to be cleaned, and recording status or other environmental variable information. The moveable unit 112 can include a main housing adapted to selectively mount components of the systems to form a unitary movable device.

A controller 128 is operably coupled with the various functional systems of robot 100 for controlling its operation. The controller 128 can be a microcontroller unit (MCU) that contains at least one central processing unit (CPU).

The fluid delivery system can include the supply tank 106 for storing a supply of cleaning fluid and a fluid distributor 107 in fluid communication with the supply tank 106 for depositing a cleaning fluid onto the surface. The cleaning fluid can be a liquid such as water or a cleaning solution specifically formulated for carpet or hard surface cleaning. The fluid distributor 107 can be one or more spray nozzles provided on the housing 112 of the robot 100. Alternatively, the fluid distributor 107 can be a manifold having multiple outlets. A fluid delivery pump 105 is provided in the fluid pathway between the supply tank 106 and the fluid distributor 107 to control the flow of fluid to the fluid distributor 107. Various combinations of optional components can be incorporated into the fluid delivery system as is commonly known in the art, such as a heater for heating the cleaning fluid before it is applied to the surface or one more fluid control and mixing valves.

At least one agitator or brush 140 can be provided for agitating the surface to be cleaned onto which fluid has been dispensed. The brush 140 can be a brushroll mounted for rotation about a substantially horizontal axis, relative to the surface over which the robot 100 moves. A drive assembly including a separate, dedicated brush motor 142 can be provided within the robot 100 to drive the brush 140. Alternatively, the brush 140 can be driven by a vacuum motor 116. Other embodiments of agitators are also possible, including one or more stationary or non-moving brushes, or one or more brushes that rotate about a substantially vertical axis.

The fluid recovery system can include an extraction path through the robot 100 having an air inlet and an air outlet, an extraction or suction nozzle 114 which is positioned to confront the surface to be cleaned and defines the air inlet, the recovery tank 118 for receiving dirt and liquid removed from the surface for later disposal, and a suction source 116 in fluid communication with the suction nozzle 114 and the recovery tank 118 for generating a working air stream through the extraction path. The suction source 116 can be the vacuum motor 116 carried by the robot 100, fluidly upstream of the air outlet, and can define a portion of the extraction path. The recovery tank 118 can also define a portion of the extraction path and can comprise an air/liquid separator for separating liquid from the working airstream. Optionally, a pre-motor filter and/or a post-motor filter (not shown) can be provided as well.

While not shown, a squeegee can be provided on the housing 112 of the robot 100, adjacent the suction nozzle 114, and is configured to contact the surface as the robot 100 moves across the surface to be cleaned. The squeegee wipes residual liquid from the surface to be cleaned so that it can be drawn into the fluid recovery pathway via the suction nozzle 114, thereby leaving a moisture and streak-free finish on the surface to be cleaned.

The drive system can include drive wheels 130 for driving the robot 100 across a surface to be cleaned. The drive wheels 130 can be operated by a common drive motor or individual drive motors 131 coupled with the drive wheels 130 by a transmission, which may include a gear train assembly or another suitable transmission. The drive system can receive inputs from the controller 128 for driving the robot 100 across a floor, based on inputs from the navigation/mapping system. The drive wheels 130 can be driven in a forward or reverse direction in order to move the unit forwardly or rearwardly. Furthermore, the drive wheels can be operated simultaneously or individually in order to turn the unit in a desired direction.

The controller 128 can receive input from the navigation/mapping system for directing the drive system to move the robot 100 over the surface to be cleaned. The navigation/mapping system can include a memory 168 that stores maps for navigation and inputs from various sensors, which is used to guide the movement of the robot 100. For example, wheel encoders 172 can be placed on the drive shafts of the wheel motors 131 and are configured to measure the distance travelled. This measurement can be provided as input to the controller 128.

Motor drivers 103, 146, 144, and 148 can be provided for controlling the pump 105, brush motor 142, vacuum motor 116, and wheel motors 131, respectively, and act as an interface between the controller 128 and the motors 105, 142, 116, 131. The motor drivers 103, 146, 144, and 148 may be an integrated circuit chip (IC). For the wheel motors 131, one motor driver 148 can control the motors 131 simultaneously.

The motor drivers 103, 146, 144, and 148 for the pump 105, brush motor 142, vacuum motor 116, and wheel motors 131 can be electrically coupled to a battery management system 150 which includes a rechargeable battery or battery pack 152. In one example, the battery pack 152 can include lithium ion batteries. Charging contacts for the battery pack 152 can be provided on the exterior of the unit 112. The docking station 10 (FIG. 1) can be provided with corresponding charging contacts.

The controller 128 is further operably coupled with a user interface (UI) 124 for receiving inputs from a user. The user interface 124 can be used to select an operation cycle for the robot 100 or otherwise control the operation of the robot 100. The user interface 124 can have a display 156, such as an LED display, for providing visual notifications to the user. A display driver 158 can be provided for controlling the display 156, and acts as an interface between the controller 128 and the display 156. The display driver 158 may be an integrated circuit chip (IC). The robot 100 can further be provided with a speaker (not shown) for providing audible notifications to the user.

The user interface 124 can further have one or more switches 126 that are actuated by the user to provide input to the controller 128 to control the operation of various components of the robot 100. The switches 126 can be actuated by a button, toggle, or any other suitable actuating mechanism. A switch driver 125 can be provided for controlling the switch 126, and acts as an interface between the controller 128 and the switch 126.

The controller 128 can further be operably coupled with various sensors for receiving input about the environment and can use the sensor input to control the operation of the robot 100. The sensor input can further be stored in the memory 168 and/or used to develop maps for navigation. Some exemplary sensors are illustrated in FIG. 2, although it is understood that not all sensors shown may be provided, additional sensors not shown may be provided, and that the sensors can be provided in any combination.

The robot 100 can include a positioning or localization system having one or more sensors determining the position of the robot relative to objects. The localization system can include one or more infrared (IR) obstacle sensors 170 for distance and position sensing. The obstacle sensors 170 can be mounted to the housing 112 of the robot 100, such as in the front of robot 100 to determine the distance to obstacles in front of the robot 100. Input from the obstacle sensors 170 can be used to slow down and/or adjust the course of the robot 100 when objects are detected.

Bump sensors 174 can also be provided for determining front or side impacts to the robot 100. The bump sensors 174 may be integrated with a bumper on the housing 112 of the robot 100. Output signals from the bump sensors 174 provide inputs to the controller 128 for selecting an obstacle avoidance algorithm.

In addition to the obstacle and bump sensors 170, 174, the localization system can include additional sensors, including a side wall sensor 176, one or more cliff sensors 180, and/or an accelerometer 178. The side wall or wall following sensor 176 can be located near the side of the robot 100 and can include a side-facing optical position sensor that provides distance feedback and controls the robot 100 so that the robot 100 can follow near a wall without contacting the wall. The cliff sensors 180 can be bottom-facing optical position sensors that provide distance feedback and control the robot 100 so that the robot 100 can avoid excessive drops such as stairwells or ledges. In addition to optical sensors, the wall following and cliff sensors 176, 180 can be mechanical or ultrasonic sensors.

The accelerometer 178 can be an integrated inertial sensor located on the controller 128 and can be a nine-axis gyroscope or accelerometer to sense linear, rotational and magnetic field acceleration. The accelerometer 178 can use acceleration input data to calculate and communicate change in velocity and pose to the controller 128 for navigating the robot 100 around the surface to be cleaned.

The robot 100 can further include one or more lift-up sensors 182, which detect when the robot 100 is lifted off the surface to be cleaned, such as when the user picks up the robot 100. This information is provided as an input to the controller 128, which will halt operation of the pump 105, brush motor 142, vacuum motor 116, and/or wheel motors 131. The lift-up sensors 182 can also detect when the robot 100 is in contact with the surface to be cleaned, such as when the user places the robot 100 back on the ground; upon such input, the controller 128 may resume operation of the pump 105, brush motor 142, vacuum motor 116, and wheel motors 131.

While not shown, the robot 100 can optionally include one or more sensors for detecting the presence of the supply 106 and recovery 118 tanks. For example, one or more pressure sensors for detecting the weight of the supply tank 106 and the recovery tank 118 can be provided. This information is provided as an input to the controller 128, which may prevent operation of the robot 100 until the supply 106 and recovery 118 tanks are properly installed. The controller 128 may also direct the display 156 to provide a notification to the user that the supply tank 106 or recovery tank 118 is missing.

The robot 100 can further include one or more floor condition sensors 186 for detecting a condition of the surface to be cleaned. For example, the robot 100 can be provided with an infrared dirt sensor, a stain sensor, an odor sensor, and/or a wet mess sensor. The floor condition sensors 186 provide input to the controller 128, which may direct operation of the robot 100 based on the condition of the surface to be cleaned, such as by selecting or modifying a cleaning cycle.

As discussed briefly for the system of FIG. 1, the artificial barrier system 20 can also be provided for containing the robot 100 within a user-determined boundary. The artificial barrier system 20 can include an artificial barrier generator (not shown) that comprises a housing with at least one sonic receiver or radio frequency receiver for receiving a sonic or radio frequency signal from the robot 100 and at least one IR transmitter for emitting an encoded IR beam towards a predetermined direction for a predetermined period of time. The artificial barrier generator can be battery-powered by rechargeable or non-rechargeable batteries. The artificial barrier generator can include a port such as a Universal Serial Bus (USB) port to accept power from a mobile charging device such as a USB battery pack to either charge the rechargeable batteries or directly power the artificial barrier system In one example, the sonic receiver can comprise a microphone configured to sense a predetermined threshold sound level, which corresponds with the sound level emitted by the robot 100 when it is within a predetermined distance away from the artificial barrier generator. In another example, the radio frequency receiver can detect a radio frequency signal such as a service set identifier (SSID) that is broadcast by a robot 100 or docking station 10 where either the robot 100 or docking station 10 can include electronics that can be configured to act as a WiFi access point (AP). Optionally, the artificial barrier generator can further comprise a plurality of IR emitters near the base of the housing configured to emit a plurality of short field IR beams around the base of the artificial barrier generator housing. The artificial barrier generator can be configured to selectively emit one or more IR beams for a predetermined period of time, but only after the microphone senses the threshold sound level or the radio frequency receiver senses the SSID, which indicates the robot 100 is nearby. Thus, the artificial barrier generator is able to conserve power by emitting IR beams only when the robot 100 is in the vicinity of the artificial barrier generator or actively performing a cleaning operation on the surface to be cleaned.

The robot 100 can have a plurality of IR transceivers 192 around the perimeter of the robot 100 to sense the IR signals emitted from the artificial barrier system 20 and output corresponding signals to the controller 128, which can adjust drive wheel 130 control parameters to adjust the position of the robot 100 to avoid the boundaries established by the artificial barrier encoded IR beam and the short field IR beams. This prevents the robot 100 from crossing the artificial barrier boundary and/or colliding with the artificial barrier generator housing. The IR transceivers 192 can also be used to guide the robot 100 toward the docking station 10 (FIG. 1).

In operation, sound emitted from the robot 100 greater than a predetermined threshold sound level is sensed by the microphone and triggers the artificial barrier generator to emit one or more encoded IR beams as described previously for a predetermined period of time. The IR transceivers 192 on the robot 100 sense the IR beams and output signals to the controller 128, which then manipulates the drive system to adjust the position of the robot 100 to avoid the border established by the artificial barrier system 20 while continuing to perform a cleaning operation on the surface to be cleaned.

With reference to FIGS. 1 and 2, the toilet 30 is part of the existing infrastructure of many homes and other buildings, and the deep cleaning robot 100 can utilize the existing infrastructure via the toilet 30 for water filling and waste disposal or dumping. In one embodiment, the water fill and dump offers long term automation of the cleaning cycle for the deep cleaning robot 100.

Figure 8:
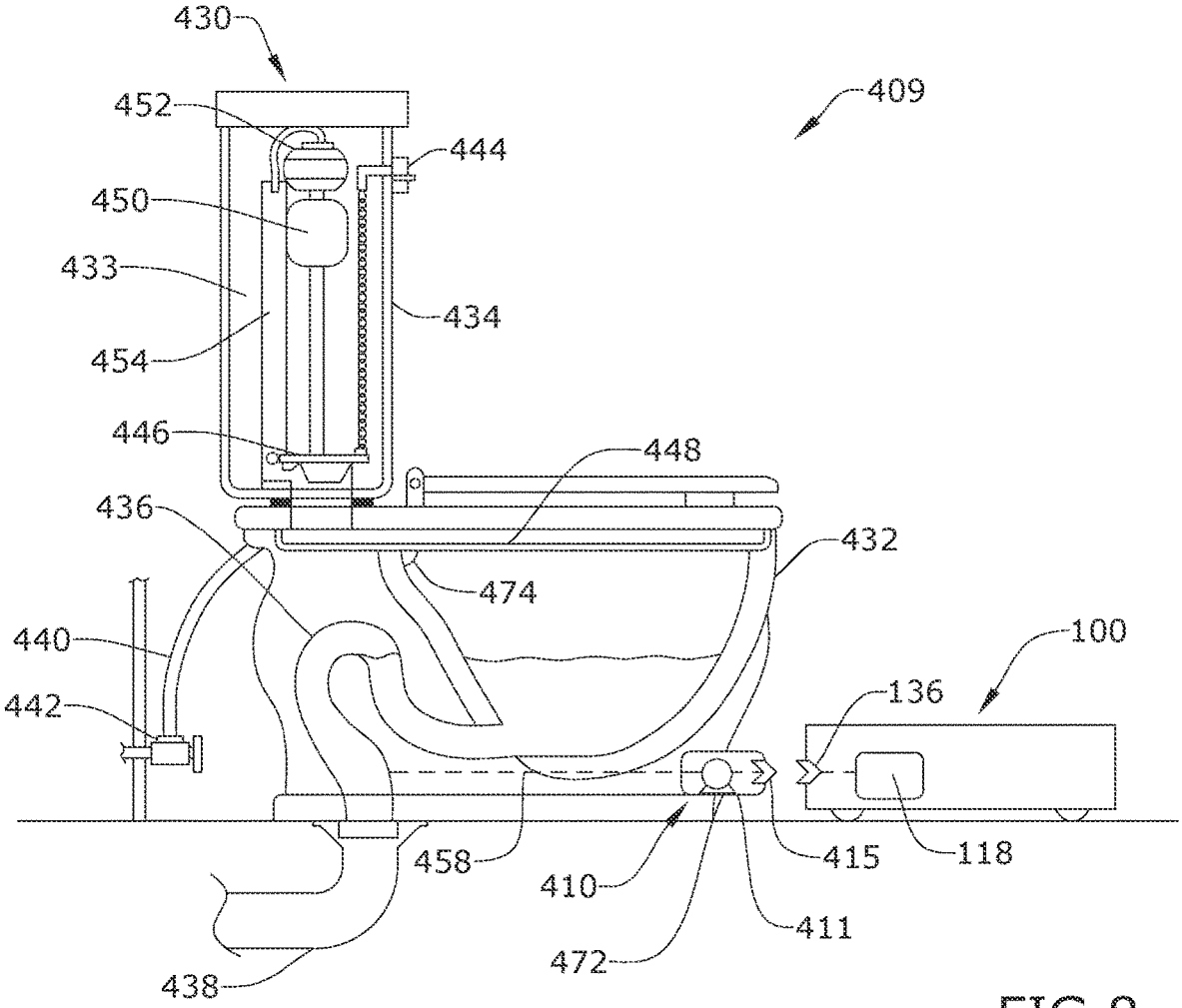
FIG. 8 is a schematic view of one embodiment of a disposal system of the toilet docking station from FIG. 1.
Figure 9:
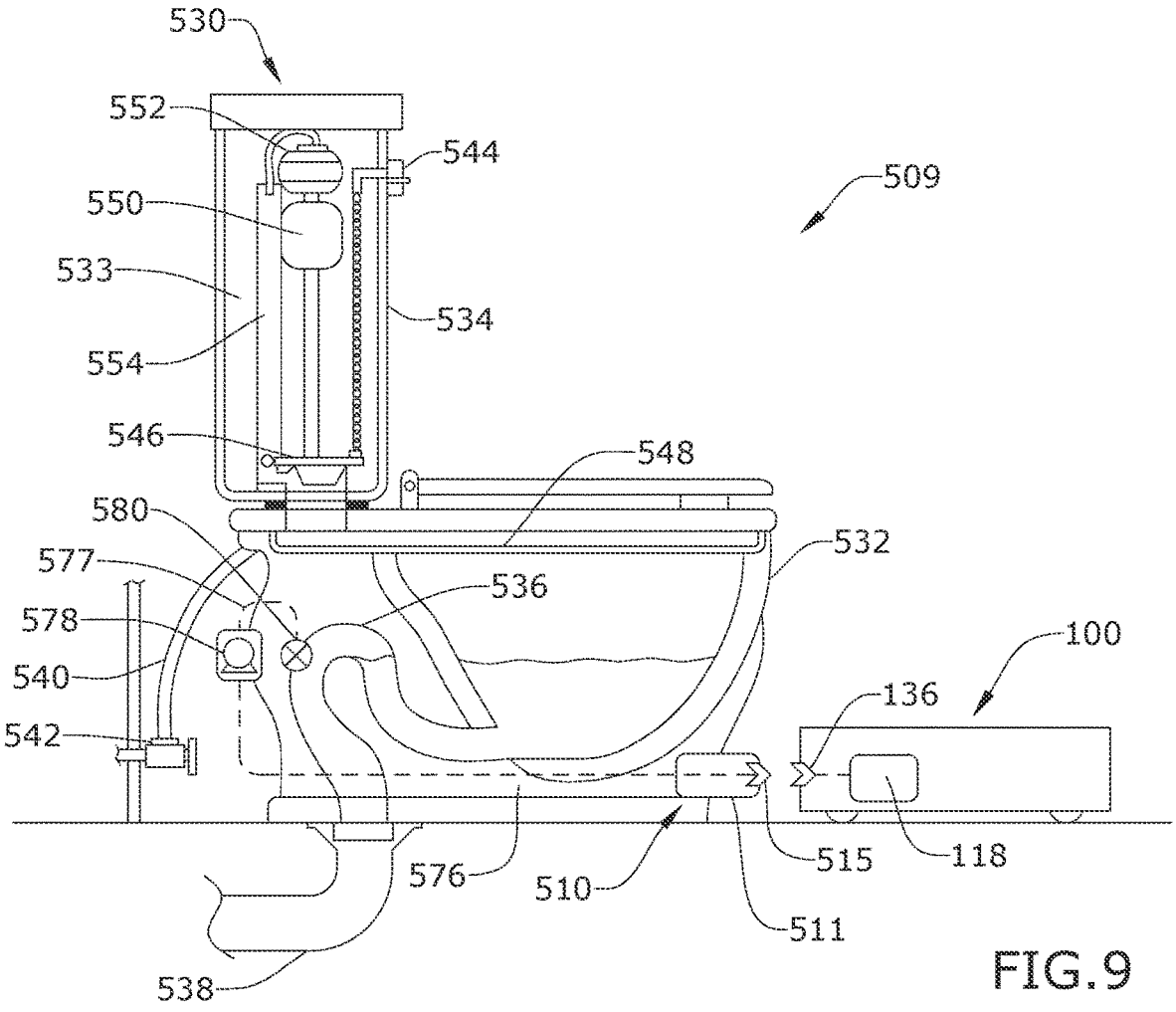
FIG. 9 is a schematic view of another embodiment of a disposal system of the toilet docking station from FIG. 1.
Figure 10:
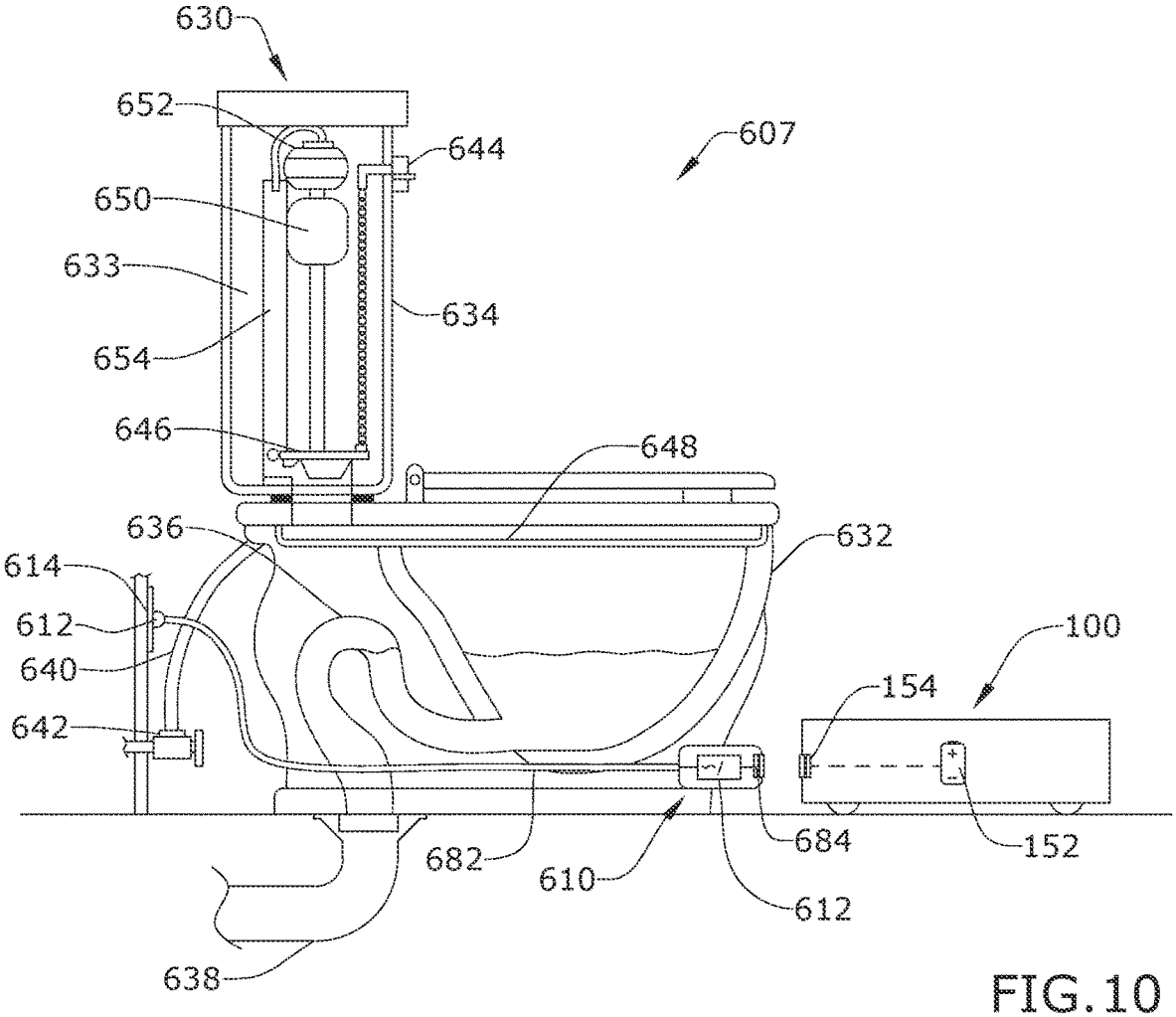
FIG. 10 is a schematic view of one embodiment of a charging system of the toilet docking station from FIG. 1.

The docking station 10 integrated with the toilet 30 can include a liquid supply system for refilling the supply tank 106 of the robot 100, and a disposal system for emptying the recovery tank 118 of the robot 100. Embodiments of a liquid supply system of the docking station 10 are shown in FIGS. 3-7. Embodiments of a disposal system of the docking station 10 are shown in FIGS. 8-9. The docking station 10 can include a charging system for recharging the robot 100. One embodiment of the charging system of the docking station 10 is shown in FIG. 10. These embodiments can be alone or in any combination thereof to provide the docking station 10 with liquid supply, disposal, and/or charging capabilities.

An existing toilet 30 can be retrofitted with a docking station 10 according to any of the embodiments discussed herein using an after-market kit. Alternatively, a toilet 30 can be supplied with an integrated docking station 10 from the manufacturer, according to any of the embodiments discussed herein.

Figure 3:
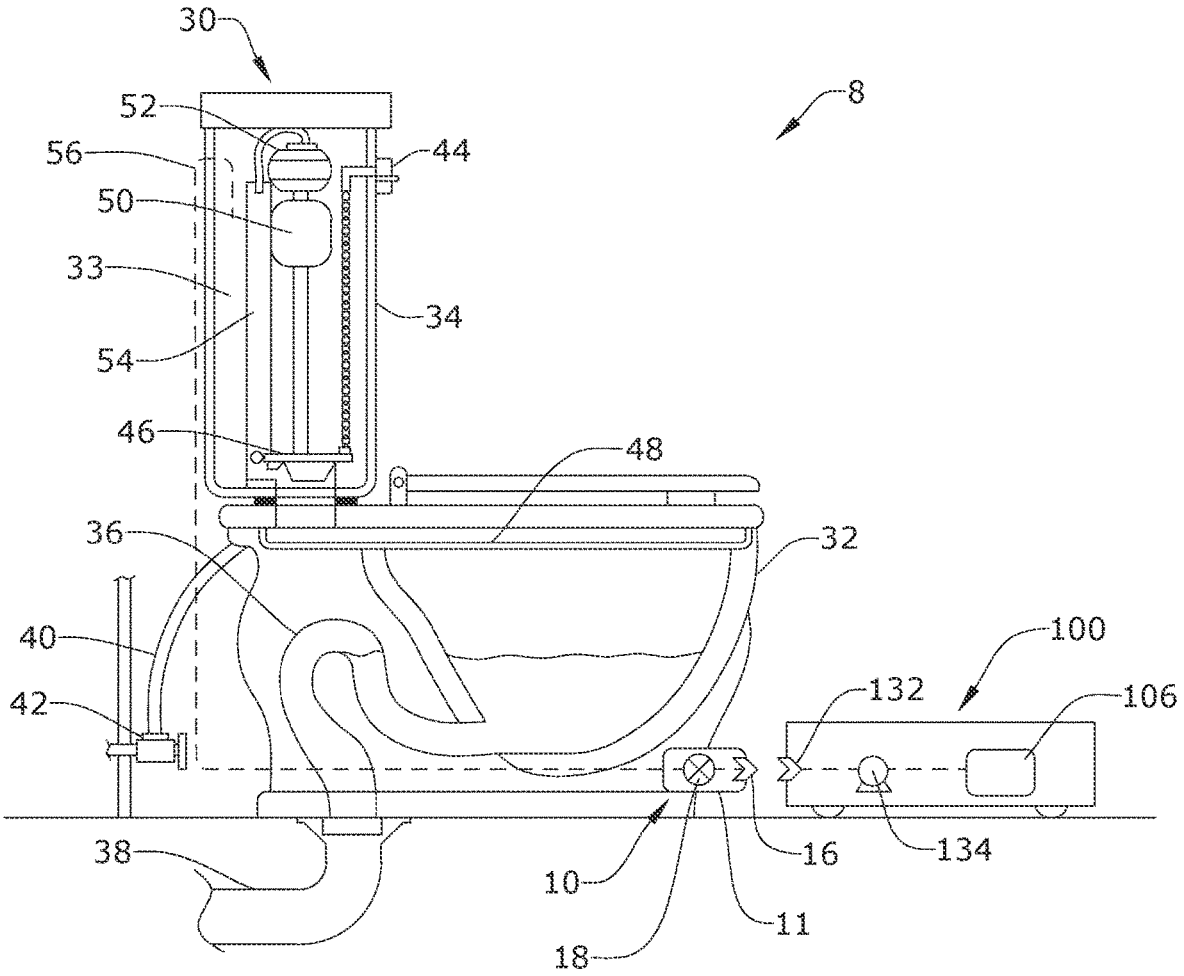
FIG. 3 is a schematic view of one embodiment of a liquid supply system of the toilet docking station from FIG. 1.

Turning to FIG. 3, the toilet 30 of the system 5 can include conventional features, such as a bowl 32 connected to a tank 34 that enables filling the bowl 32 with water. The bowl 32 holds water and has a trap or siphon 36 connected to a drain 38 for disposing of waste water and waste. The toilet 30 can be connected with a household water supply via a water line 40, which typically includes a stop valve 42 for optionally shutting off water supply to the toilet 30.

The tank contains reserve water 33 for refilling the bowl 32, plus mechanisms for flushing the bowl 32 and refilling the tank 34. A handle 44 on the exterior of the tank 34 is used as an actuator for the flushing mechanism and is operably coupled with a flush valve 46 which normally closes an outlet orifice of the tank 34.

When the toilet 30 is flushed by rotating the handle 44, the flush valve 46 opens and water from the tank 34 enters the bowl 32 quickly to activate the siphon 36. The water can enter the bowl 32 via holes in a rim 48 of the bowl 32. The waste and water from the bowl 32 is sucked into the drain 38, which may connect to a septic tank or a system connected to a sewage treatment plant.

Once the tank 34 has emptied, the flush valve 46 closes so that the tank 34 can be refilled by the refill mechanism. The refill mechanism can include a float 50 coupled with a fill valve 52 that turns the supply of water on and off. The fill valve 52 turns the supply of water on when the water level in the tank 34 drops and the float falls. The fill valve 52 sends water into the tank 34, and also into the bowl 32 via an overflow tube 54. When the water level in the tank 34 rises to a predetermined level, the float 50 closes the fill valve 52 and turns the supply of water off.

A liquid supply system 8 for the docking station 10 can include a supply conduit 56 that draws water from the toilet tank 34, which provides a low-pressure source of water for refilling the robot 100, and a water supply coupling 16 on a housing 11 of the docking station 10 configured to mate or otherwise couple with a corresponding water receiver coupling 132 on the robot 100.

The supply conduit 56 can provide water from the toilet tank 34 to the water supply coupling 16. The water receiver coupling 132 on the robot 100 can be in fluid communication with the robot supply tank 106, such that fluid received by the receiver coupling 132 is provided to the robot supply tank 106.

The robot 100 can include a fill pump 134 for drawing clean water from the toilet tank 34 into the robot supply tank 106 via the supply conduit 56 and, optionally, one or more additional conduits (not shown) fluidly coupling the components of the robot 100 together. The robot fill pump 134 can be provided in addition to the fluid delivery pump 105 (FIG. 2) provided in the fluid pathway between the supply tank 106 and the fluid distributor 107 (FIG. 2) to control the flow of fluid to the fluid distributor 107. Alternatively, a single pump can operate as both a fill pump and a fluid delivery pump, with suitable conduits and valving supporting operation of the pump for either filling or fluid delivery. In another alternative embodiment, the fill pump 134 can be provided in the docking station 10 rather than in the robot 100.

Optionally, the docking station 10 can include a shut-off valve 18 for closing the fluid pathway through the supply conduit 56 when the robot 100 is not docked with the docking station 10. The shut-off valve 18 can be configured to automatically open when the robot 100 is docked with the docking station 10. For example, the shut-off valve 18 can be mechanically engaged by a portion of the robot 100, or more specifically by a portion of the water receiver coupling 132, to open a fluid pathway between the supply conduit 56 and the supply tank 106.

Figure 4:
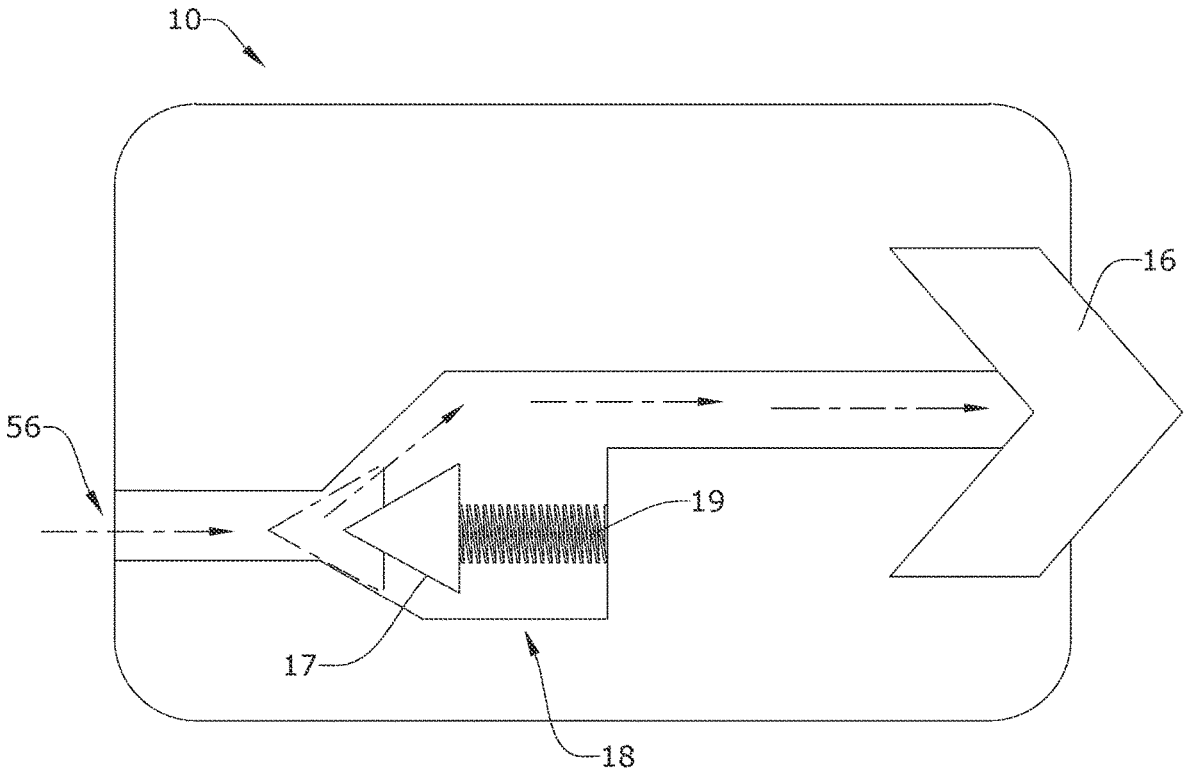
FIG. 4 is a schematic view of one embodiment of a shut-off valve for the system of FIG. 3.

In one example, shown in FIG. 4, the shut-off valve 18 can be a spring-loaded valve that opens when the fill pump 134 (FIG. 3) is activated and applies negative pressure to open the shut-off valve 18. When the robot 100 docks with the docking station 10, the spring-loaded valve 18 can remain in the normally closed position, with a valve plunger 17 biased by a spring 19 as shown by the phantom line valve plunger. When the fill pump 134 energizes, the spring-loaded valve 18 is opened by the negative pressure applied by the fill pump 134, and the valve plunger 17 can open as shown by the solid line valve plunger 17.

Figure 5:
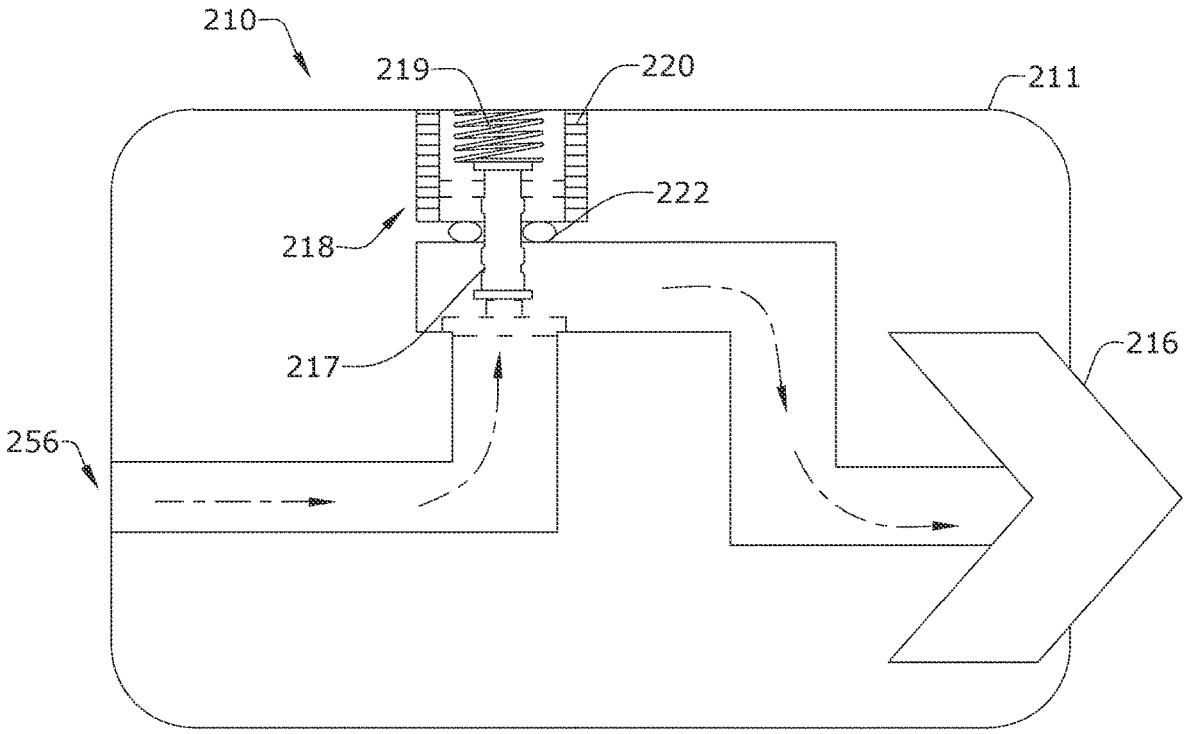
FIG. 5 is a schematic view of another embodiment of a shut-off valve for the system of FIG. 3.

In another example, shown in FIG. 5, a docking station 210 for the toilet 30 of FIG. 3 can include a shut-off valve 218 that can be an electromechanically operated solenoid valve 218 that opens by an electric current through a solenoid 220 when the fill pump 134 of the robot 100 (FIG. 3) is activated. Docking station 210 is similar to the docking station 10 previously described. Therefore, like parts will be identified with like numerals increased by 200, and it is understood that the description of like parts of the docking station 10 applies to the docking station 210, unless otherwise noted. When the robot 100 docks with the docking station 210, a valve plunger 217 of the solenoid 220 can remain in the normally closed position, as shown by the phantom line valve plunger in FIG. 5. When the fill pump 134 energizes, the solenoid 220 can apply an electric current to open the shut-off valve 218, as shown by the solid line valve plunger 217. A spring 219 can be used to hold the valve plunger 217 closed while the solenoid 220 is not activated. Optionally, a seal 222 can be provided at the interface between the valve plunger 217 and the supply conduit 256 to prevent liquid from escaping from the supply conduit 256.

In operation and referring back to FIG. 3, in a successful docking between the robot 100 and the docking station 10, the water receiver coupling 132 on the robot 100 mates or otherwise fluidly couples with the water supply coupling 16 of the docking station 10. Next, the fill pump 134 energizes and draws liquid from the toilet tank 34, through the supply conduit 56, and into the robot supply tank 106.

The fill pump 134 can be automatically energized upon a successful docking between the robot 100 and the docking station 10. In one example, once the robot 100 docks successfully, a filling cycle or mode of operation can be initiated. Prior to initiation of the filling mode, the robot 100 may send a confirmation signal to the docking station 10 indicating that the robot 100 has successfully docked and is ready to commence filling. For example, an RF signal can be sent from the robot 100 to the docking station 10, and back to the robot 100. Alternatively, a pulsed signal can be sent through a charging pathway between the corresponding charging contacts for the battery pack 152 (FIG. 2) and the docking station 10. As yet another alternative, an IR signal can be sent to be robot 100 to an IR receiver on the docking station. As yet another alternative the robot 100 can communicate with the docking station 10 via an electrical signal through the mated water receiver and water supply couplings 132, 16.

The filling mode is preferably automatically initiated after the confirmation signal is sent. The filling mode can be controlled by the controller 128 on the robot (FIG. 2) and can automatically initiate once the robot 100 is confirmed to be docked in the docking station 10.

Alternatively, the filling mode can be manually initiated, with the user initiating the servicing mode by pressing a button on the user interface 124 (FIG. 2). Manual initiation of the filling mode may be preferred when the bathroom or toilet 30 is in use when the robot 100 returns to the docking station 10, and the user would prefer to delay the filling mode. The button on the user interface 124 can be configured to both pause and re-initiate the filling mode. The filling mode may be locked-out by the controller 128 when the robot 100 is not docked to prevent inadvertent initiation of the filling mode.

The fill pump 134 can be automatically de-energized when the robot supply tank 106 is full. For example, the supply tank 106 can be provided with a fluid level sensor (not shown) that communicates with the controller 128 on the robot 100 when the supply tank 106 is full and filling is complete.

Figure 6:
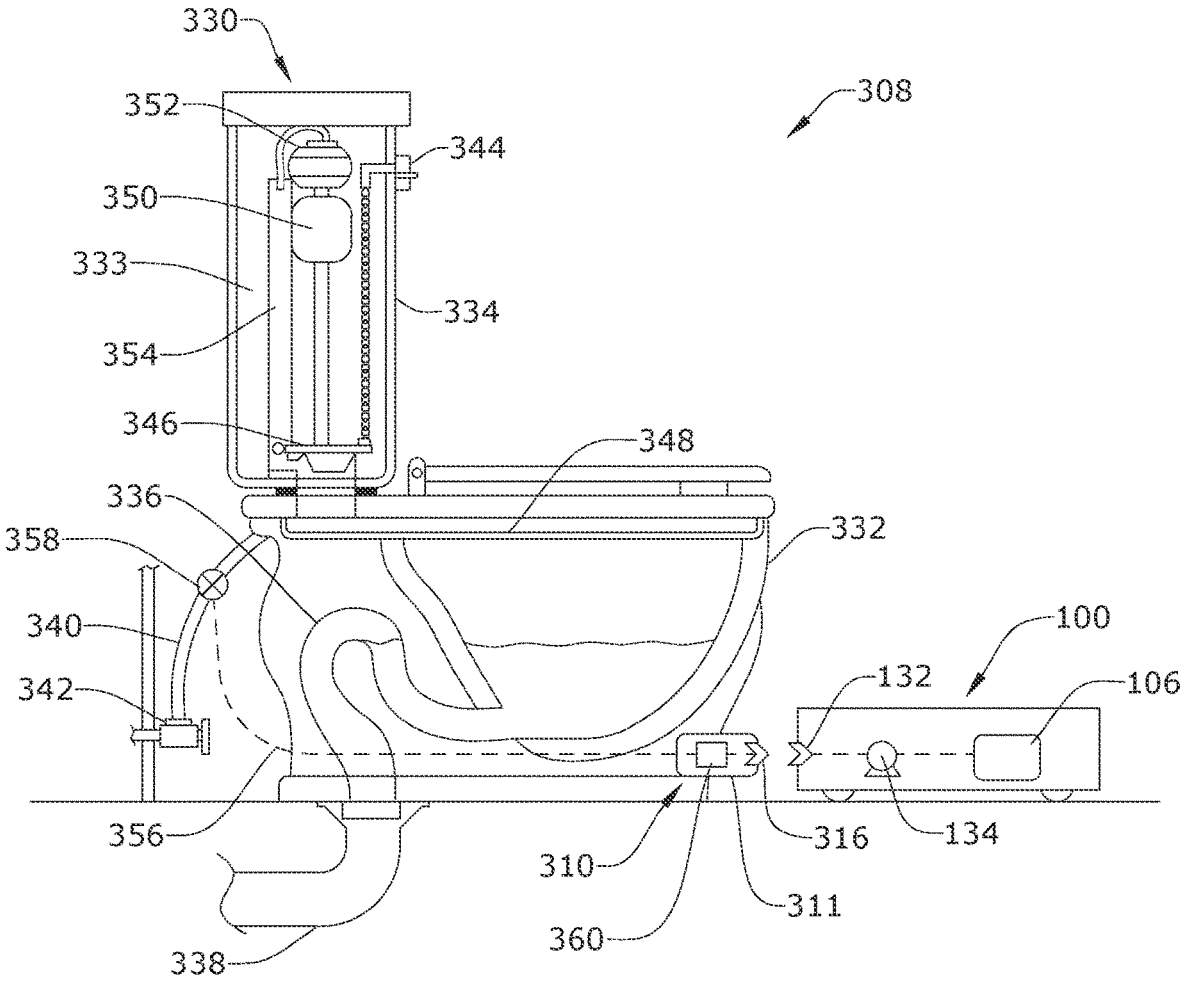
FIG. 6 is a schematic view of another embodiment of a liquid supply system of the toilet docking station from FIG. 1.
Figure 7:
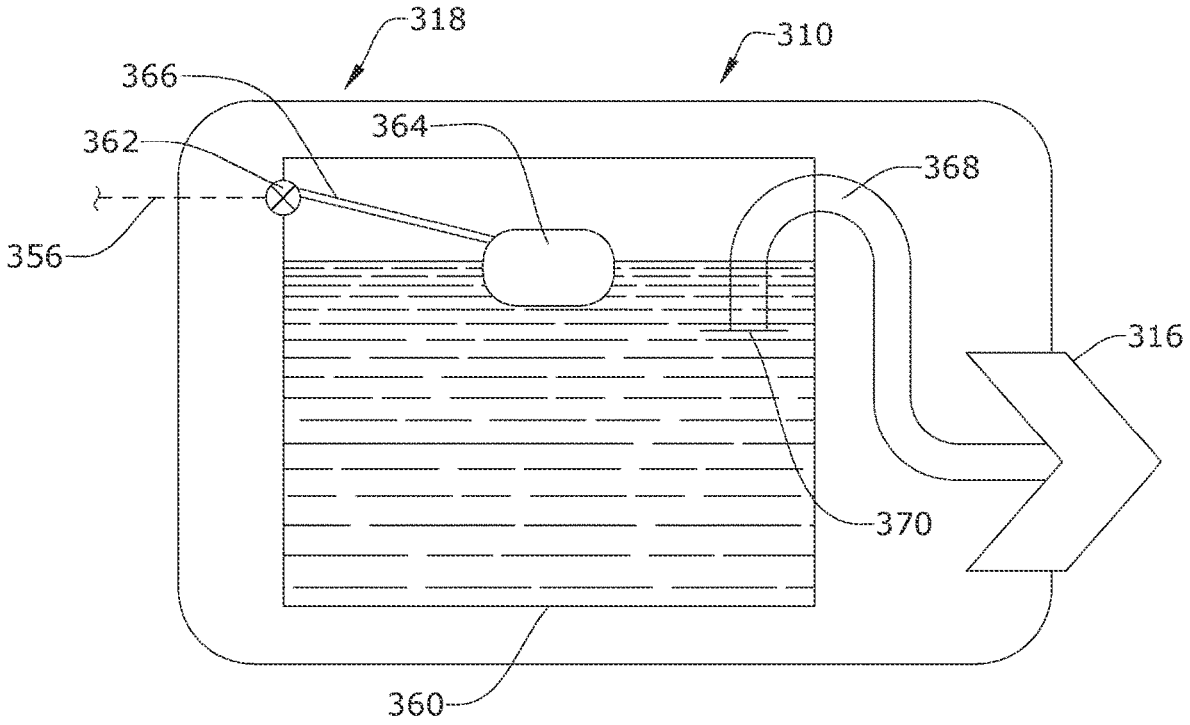
FIG. 7 is a schematic view of an intermediate reservoir for the system of FIG. 6.

FIG. 6 a schematic view of another embodiment of a liquid supply system 308 of a toilet docking station 310. The liquid supply system 308 is similar to the liquid supply system 8 previously described. Therefore, like parts will be identified with like numerals increased by 300, and it is understood that the description of like parts of the liquid supply system 8 applies to the liquid supply system 308, unless otherwise noted. In the embodiment of FIG. 6, instead of drawing low pressure liquid out of the toilet tank 334, a high-pressure supply conduit 356 draws water from the water line 340 supplying the toilet 330 with water, which provides a high pressure source of water for refilling the robot 100, and is connected directly to the docking station 310. A flow valve 358 can be integrated or otherwise provided in the water line 340 for controlling the flow to the supply conduit 356.

A water supply coupling 316 on a housing 311 of the docking station 310 is configured to mate or otherwise couple with a corresponding water receiver coupling 132 on the robot 100. The supply conduit 356 provides water from the water line 340 to the water supply coupling 316. The water receiver coupling 132 on the robot 100 is in fluid communication with the robot supply tank 106, such that fluid received by the water receiver coupling is provided to the robot supply tank 106.

The docking station 310 further can include an intermediate reservoir with a float-style shut-off valve similar to the float 350 shut-off assembly in the toilet tank. One example of an intermediate reservoir 360 and float-style shut-off valve 318 is shown in more detail in FIG. 7. The float shut-off assembly 318 includes a float 364 coupled with a reservoir refill valve 362 that turns the supply of water to the water supply coupling 316 on and off. The float 364 includes a float rod 366 that presses against the refill valve 362 to close the refill valve 362 when the intermediate reservoir 360 is full. The refill valve 362 turns the supply of water on when the water level in the intermediate reservoir 360 drops and the float 364 falls. Opening the refill valve 362 sends water from the high-pressure supply conduit 356 into the intermediate reservoir 360. When the water level in the intermediate reservoir 360 rises to a predetermined level, the float 364 closes the reservoir refill valve 362 and turns the supply of water off. A fill tube 368 provides water from the intermediate reservoir 360 to the water supply coupling 316 and has an inlet end 370 which may be submerged in the water of the intermediate reservoir 360. The reservoir refill valve 362 can be configured to open when the water level in the intermediate reservoir 360 falls below the inlet 370 of the fill tube 368.

In operation and referring back to FIG. 6, in a successful docking between the robot 100 and the docking station 310, the water receiver coupling 132 on the robot 100 mates or otherwise fluidly couples with the water supply coupling 316 of the docking station 310. Next, the fill pump 134 energizes and draws liquid from the intermediate reservoir 360 of the docking station 310.

The fill pump 134 may be automatically energized upon a successful docking between the robot 100 and the docking station 310 and may be automatically de-energized when the robot supply tank 106 is full, as described above with respect to the liquid supply system 308 of FIG. 3. Alternatively, the filling mode can be manually initiated, as described above with respect to the liquid supply system 308 of FIG. 3.

Filling from the intermediate reservoir 360, rather than directly from the toilet tank 334, may reduce coupling issues between the robot 100 and docking station 310. The intermediate reservoir 360 also has less head pressure from gravity as compared with the higher toilet tank 334. The docking station 310 with intermediate reservoir 360 can also be readily adaptable to other appliances, including but not limited to a dishwasher, refrigerator, washing machine, humidifier, or clothes dryer.

FIG. 8 is a schematic view of one embodiment of a disposal system 409 of a toilet docking station 410. The disposal system 409 can be used in combination with any embodiment of the liquid supply systems disclosed herein and includes a disposal pump 472 in the docking station 410 that is connected to a disposal conduit 458 plumbed to the toilet 430 downstream from the siphon 436 and upstream of the drain 438. The disposal pump 472 can be electrically powered by a power supply, such as via connection of the docking station 410 to a wall outlet 14 as shown in FIG. 1.

The disposal system 409 further includes a waste receiver coupling 415 on a housing 411 of the docking station 410 configured to mate or otherwise couple with a corresponding waste disposal coupling 136 on the robot. The disposal conduit 458 carries waste from the recovery tank 118 to the toilet plumbing downstream from the siphon 436 and upstream of the drain 438. The waste disposal coupling 136 on the robot 100 is in fluid communication with the robot recovery tank 118, such that waste collected by the recovery tank 118 can be disposed of by the disposal system via the docked or mated couplings 415, 136. The inlet side of the disposal pump 472 is coupled with the waste receiver coupling 415, while the outlet side of the disposal pump 472 is coupled with the disposal conduit 458.

Optionally, one or more additional conduits (not shown) can fluidly couple the components of the robot 100 together and/or the components of the docking station 410 together. Alternatively, for the robot 100, the waste disposal coupling 415 can be provided directly on the recovery tank 118 and can be configured to close an outlet of the recovery tank 118 when the robot 100 is not docked with the docking station 410 and further be configured to open the outlet of the recovery tank 118 when the robot 100 is docked with the docking station 410.

Optionally, the handle 444 of the toilet 430 can be an automated handle configured for communication with the robot 100 or docking station 410. During or after waste evacuation from the robot 100, the robot 100 or docking station 410 can send a signal to the automated handle to flush the toilet 430. The toilet 430 can also optionally be provided with a bowl level sensor 474 to prevent waste from filling a clogged toilet 430.

In operation, in a successful docking between the robot 100 and the docking station 410, the waste disposal coupling 136 on the robot 100 mates or otherwise fluidly couples with the waste receiver coupling 415 of the docking station 410. Next, the disposal pump 472 in the docking station 410 energizes and creates suction to draw waste from the recovery tank 118 through the disposal conduit 458, and into the drain 438 of the toilet 430, which may connect to a septic tank or a system connected to a sewage treatment plant.

The disposal pump 472 can be automatically energized upon a successful docking between the robot 100 and the docking station 410. In one example, once the robot 100 docks successfully, an emptying cycle or mode of operation can be initiated. Prior to initiation of the emptying mode, the robot 100 can send a confirmation signal to the docking station 410 indicating that the robot 100 has successfully docked and is ready to commence emptying. For example, an RF signal can be sent from the robot 100 to the docking station 410, and back to the robot 100. Alternatively, a pulsed signal can be sent through the charging pathway between the corresponding charging contacts for the battery pack 152 (FIG. 2) and the docking station 410. As yet another alternative, an IR signal can be sent to be robot 100 to an IR receiver on the docking station 410. As yet another alternative the robot 100 can communicate with the docking station 410 via an electrical signal through the mated waste receiver and waste supply couplings 415, 136.

The emptying mode is preferably automatically initiated after the confirmation signal is sent. The emptying mode can be controlled by a controller (not shown) on the docking station 410 and can automatically initiate once the robot 100 is confirmed to be docked in the docking station 410.

Alternatively, the emptying mode can be manually initiated, with the user initiating the emptying mode by pressing a button on the user interface 124 (FIG. 2). Manual initiation of the emptying mode may be preferred when the bathroom or toilet 430 is in use when the robot 100 returns to the docking station 410, and the user would prefer to delay the emptying mode. The button on the user interface 124 can be configured to both pause and re-initiate the emptying mode. The emptying mode may be locked-out by the controller 128 on the robot 100 when the robot 100 is not docked to prevent inadvertent initiation of the emptying mode.

The disposal pump 472 can be automatically de-energized when the robot recovery tank 118 is empty. For example, the recovery tank 118 can be provided with a level sensor (not shown) that communicates with the controller on the docking station 410 when the recovery tank 118 is empty and emptying is complete.

FIG. 9 is a schematic view of another embodiment of a disposal system 509 of a toilet docking station 510. The disposal system 509 is similar to the disposal system 409 previously described. Therefore, like parts will be identified with like numerals increased by 100, and it is understood that the description of like parts of the disposal system 409 applies to the disposal system 509, unless otherwise noted. The exemplary disposal system 509 can be used in combination with any embodiment of the liquid supply systems disclosed herein. The disposal system 509 includes a disposal pump 578 mounted to the toilet 530 and has an outlet side fluidly coupled to a disposal conduit 577 plumbed to the toilet 530 downstream from the siphon 536 and upstream of the drain 538. The inlet side of the disposal pump 578 is fluidly coupled to an evacuation conduit 576 in fluid communication with a waste receiver coupling 515 on a housing 511 of the docking station 510 configured to mate or otherwise couple with a corresponding waste disposal coupling 136 on the robot 100. The evacuation conduit 576 is vacuum pressurized by the disposal pump 578 and carries waste from the recovery tank 118 to the disposal pump 578. The waste disposal coupling 136 on the robot 100 is in fluid communication with the robot recovery tank 118, such that waste collected by the recovery tank 118 can be disposed of by the disposal system via the docked or mated couplings 136, 515. The disposal pump 578 can be electrically powered by a power supply, such as via connection to a wall outlet (not shown).

A valve 580 is provided between the disposal conduit 577 and the passageway between the siphon 536 and drain 538 of the toilet 530, at the outlet of the disposal conduit 577 or inlet to the passageway. In one example, the valve 580 can comprise a flapper valve adapted to create a water-tight seal at the inlet to the passageway before and after waste is evacuated from the robot 100. When the disposal pump 578 is energized and waste flows through the disposal conduit 577, the flapper valve 580 opens, allowing the waste to flow into the passageway between the siphon 536 and drain 538 of the toilet 530. After, the flapper valve 580 closes and reforms the water-tight seal.

The disposal pump 578 can mount to the toilet 530 separately from the docking station 510. In the example illustrated herein, the disposal pump 578 can be mounted to the rear of the toilet 530, beneath the tank 534. Other mounting locations are possible, such as to the side of the toilet 530 or tank 534, or within the tank 534 itself.

Optionally, one or more additional conduits (not shown) can fluidly couple the components of the robot 100 together and/or the components of the docking station 510 together. Alternatively, for the robot 100, the waste disposal coupling 136 can be provided directly on the recovery tank 118 and can be configured to close an outlet of the recovery tank 118 when the robot 100 is not docked with the docking station 510 and further be configured to open the outlet of the recovery tank 118 when the robot 100 is docked with the docking station 510.

In operation, in a successful docking between the robot 100 and the docking station 510, the waste disposal coupling 136 on the robot 100 mates or otherwise fluidly couples with the waste receiver coupling 515 of the docking station 510. Next, the disposal pump 578 on the toilet 530 energizes and creates suction to draw waste from the recovery tank 118 through the evacuation conduit 576, disposal pump 578, and disposal conduit 577, and into the drain 538 of the toilet 530, which may connect to a septic tank or a system connected to a sewage treatment plant.

The disposal pump 578 can be automatically energized upon a successful docking between the robot 100 and the docking station 510. In one example, once the robot 100 docks successfully, an emptying cycle or mode of operation can be initiated, and the docking station 510 can be in communication with the disposal pump 578 to initiate the emptying mode. Prior to initiation of the emptying mode, the robot 100 may send a confirmation signal to the docking station 510 indicating that the robot 100 has successfully docked and is ready to commence emptying. For example, an RF signal can be sent from the robot 100 to the docking station 510, and back to the robot 100. Alternatively, a pulsed signal can be sent through the charging pathway between the charging contacts for the battery pack 152 (FIG. 2) and the docking station 510. As yet another alternative, an IR signal can be sent to be robot 100 to an IR receiver on the docking station 510. As yet another alternative the robot 100 can communicate with the docking station 510 via an electrical signal through the mated waste receiver and waste supply couplings 515, 136.

The emptying mode is preferably automatically initiated after the confirmation signal is sent. The emptying mode can be controlled by a controller on the docking station 510 and can automatically initiate once the robot 100 is confirmed to be docked in the docking station 510.

Alternatively, the emptying mode can be manually initiated, with the user initiating the emptying mode by pressing a button on the user interface 124 (FIG. 2). Manual initiation of the emptying mode may be preferred when the bathroom or toilet 530 is in use when the robot 100 returns to the docking station 510, and the user would prefer to delay the emptying mode. The button on the user interface 124 can be configured to both pause and re-initiate the emptying mode. The emptying mode may be locked-out by the controller 128 on the robot 100 when the robot 100 is not docked to prevent inadvertent initiation of the emptying mode.

The disposal pump 578 can be automatically de-energized when the robot recovery tank 118 is empty. For example, the recovery tank 118 can be provided with a level sensor that communicates with the controller on the docking station 510 when the recovery tank 118 is empty and emptying is complete.

FIG. 10 is a schematic view of one embodiment of a charging system 607 of a toilet docking station 610. The charging system 607 can be used in combination with any embodiment of the liquid supply systems or disposal systems disclosed herein. Charging contacts 154 for the battery pack 152 of the robot 100 can be provided on the exterior of the robot 100. The docking station 610 can be provided with corresponding charging contacts 684. As discussed above, the battery pack 152 powers various components of the robot 100, including but not limited to, motor drivers 103, 146, 144, and 148 for the pump 105, brush motor 142, vacuum motor 116, and wheel motors 131, respectively, (see FIG. 2). In one example, the charging contacts 154 provided on the robot 100 may be an electrical connector such as the DC jack 154 and the charging contacts 684 provided on the docking station 610 may be a DC plug.

The docking station 610 can be connected to a household power supply, such as a wall outlet 614, by a power cord 682. The docking station 610 can further include a converter 612 for converting AC voltage from the wall outlet 614 into DC voltage for recharging a power supply on-board the robot 100. The docking station 610 can also include various sensors and emitters for monitoring robot status, enabling auto-docking functionality, communicating with each robot, as well as features for network and/or Bluetooth connectivity.

In operation, in a successful docking between the robot 100 and the docking station 610, the charging contacts 154 on the robot 100 mate or otherwise electrically couple with the charging contacts 684 of the docking station 610. The toilet 630 can be provided with the recharging function in addition to the supply and/or disposal functions discussed above. As such, the battery 152 of the robot 100 can be recharged when the robot 100 docks with the toilet 630 for supply or disposal.

Figure 11:
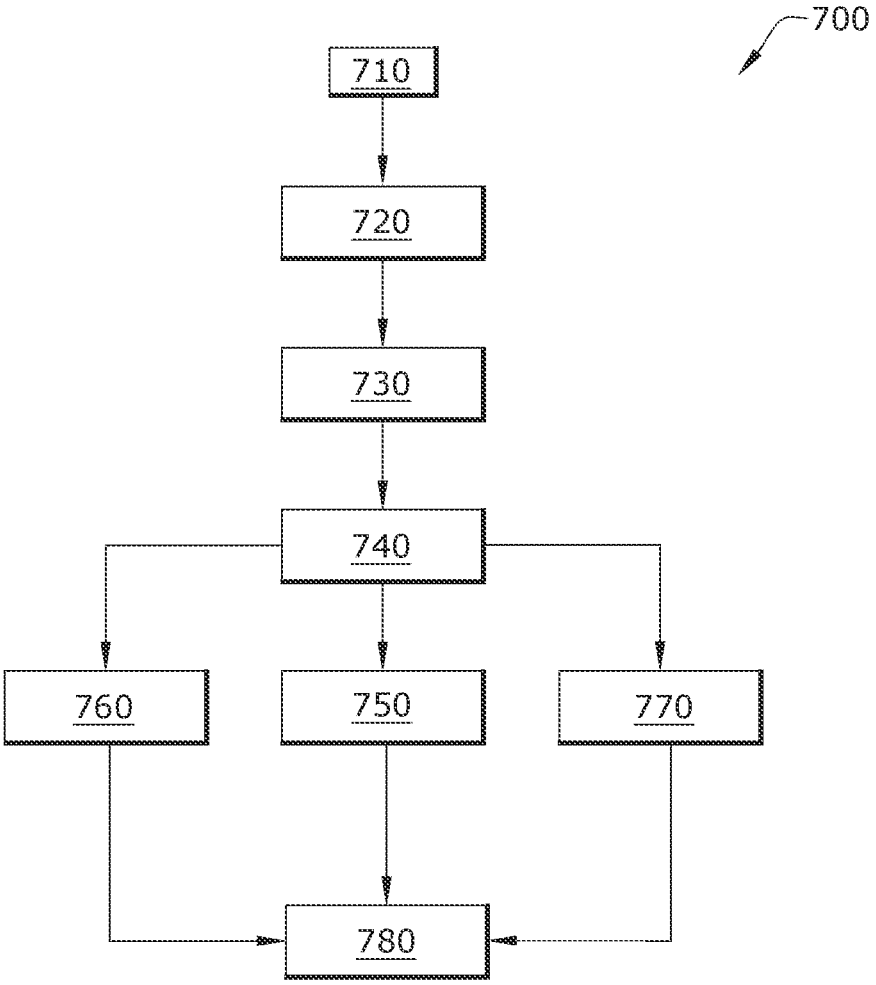
FIG. 11 is a flow chart showing a method for refilling, emptying, and recharging an autonomous deep cleaner using the system of FIG. 1.

FIG. 11 depicts one embodiment of a method 700 for refilling and emptying a deep cleaning robot 100 using the system 5 of FIG. 1. At the start 710 of the method 700, the deep cleaning robot 100 returns to the docking station 10 at step 720. This may include autonomously driving the robot 100 to the toilet 30 and docking the robot 100 with the docking station 10. The robot 100 may be guided to the toilet 30 using the IR transceivers 192 (FIG. 2). Once docked, the drive wheels 130 are stopped. The deep cleaning robot 100 may return to the docking station 10 based on any one of the level of cleaning fluid in the supply tank 106 reaching a predetermined lower limit, the level of recovered fluid in the recovery tank 118 reaching a predetermined upper limit, the charge level of the battery 152 reaching a predetermined lower limit, or after a predetermined amount of run time.

Docking the robot 100 with the docking station 10 can include one or more of: making a fluid connection between the supply tank 106 of the robot 100 and the liquid supply system of the docking station 10; making a fluid connection between the recovery tank 118 of the robot 100 and the disposal system of the docking station 10; and/or making an electrical connection between the charging contacts 154, 684 (FIG. 10) to recharge the battery pack 152 at step 730.

Once docked, a servicing cycle or mode of operation can be initiated. Prior to initiation of the serving mode, the robot 100 can send a confirmation signal to the docking station 10 indicating that the robot 100 has successfully docked at step 740 and is ready to commence refilling and emptying. For example, an RF signal can be sent from the robot 100 to the docking station 10, and back to the robot 100. Alternatively, a pulsed signal can be sent through the charging pathway between the charging contacts 154, 684. As yet another alternative, an IR signal can be sent to be robot 100 to an IR receiver on the docking station 10.

A servicing mode is preferably automatically initiated after the confirmation signal is sent at 740. The servicing mode can be controlled by the controller 128 on the robot 100 (FIG. 2) and can automatically initiate once the deep cleaning robot 100 is confirmed to be docked in the docking station 10.

Alternatively, the servicing mode can be manually initiated, with the user initiating the servicing mode by pressing a button on the user interface 124 (FIG. 2). Manual initiation of the servicing mode may be preferred when the bathroom or toilet 30 is in use when the robot 100 returns to the docking station 10, and the user would prefer to delay the servicing mode. The button on the user interface 124 can be configured to both pause and re-initiate the mode. The servicing mode may be locked-out by the controller 128 when the deep cleaning robot 100 is not docked to prevent inadvertent initiation of the servicing mode.

The servicing mode can include a refilling phase at step 750 in which water is delivered from the docking station to the supply tank of the robot. The servicing mode can also include an emptying phase at step 760 in which waste in the recovery tank 118 is emptied to the toilet 30 via the docking station 10. The servicing mode may also include a recharging phase at step 770 in which the battery 152 of the robot 100 is recharged via the docking station 10.

The refilling, emptying and/or recharging phases of the servicing mode may be performed simultaneously or sequentially, in any order and with any amount of overlap between the two phases. In yet another alternative, one of the phases can initiate after a timed delay from the initiation of the other phase.

The end of steps 750, 760, and 770 may be time-dependent, or may continue until the supply tank 106 is full, the recovery tank 118 is empty, and/or the battery 152 is recharged. After the end 780 of the servicing mode, the docked deep cleaning robot 100 can undock to resume cleaning or may remain docked until another cleaning operation is required.

While the method shown in FIG. 11 includes refilling, emptying, and recharging the deep cleaning robot, it is also understood that some embodiments of the method may only include some of the refilling or emptying or recharging steps. For example, at the start of a cleaning operation, the deep cleaning robot 100 may just require the supply tank 106 to be filled at step 750. In another example, at the end of a cleaning operation, the deep cleaning robot 100 may just require the recovery tank 118 to the emptied at step 760.

Figure 12:
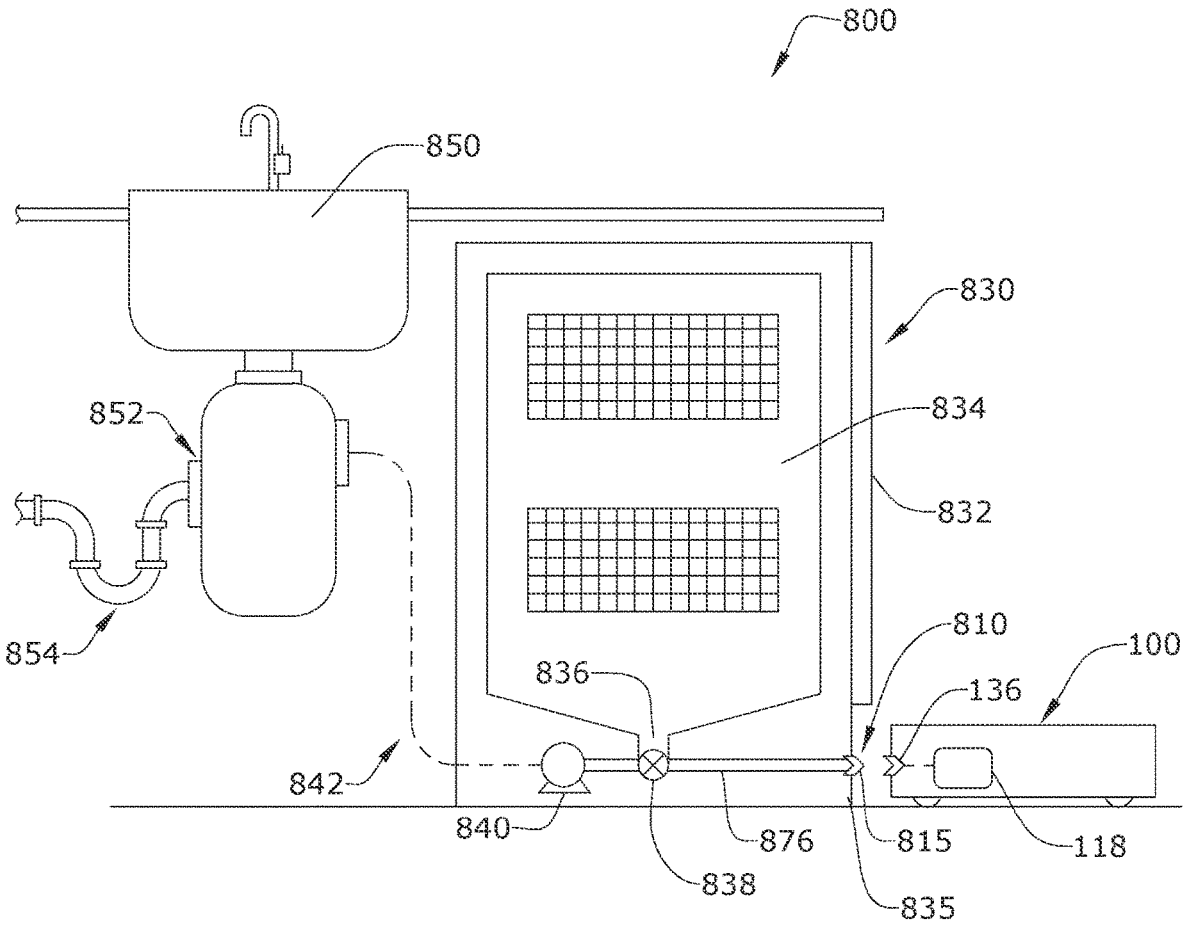
FIG. 12 is a schematic view of a system for supply and disposal for an autonomous floor cleaner, according to another embodiment of the invention.

FIG. 12 is a schematic view of a system 800 for disposal for an autonomous floor cleaner according to another embodiment of the invention. In FIG. 12, the system 800 includes the deep cleaning robot 100 and a household appliance having a docking station 810 for the robot 100. The household appliance is illustrated as a dishwasher 830. The docking station 810 is configured to automatically empty the recovery tank 118 of the robot 100 via the dishwasher 830 while utilizing the existing dishwasher 830 and plumbing infrastructure.

The deep cleaning robot 100 of FIG. 12 can be configured as any type of autonomous deep cleaner. While not shown, the system 800 can further include the artificial barrier system 20 (FIG. 1) as described previously for containing the robot 100 within a user-determined boundary. Optionally, the docking station 810 can further be connected to a household power supply, such as a wall outlet, and can include a converter for converting the AC voltage into DC voltage for recharging a power supply on-board the robot 100. The docking station 810 can also include various sensors and emitters for monitoring robot status, enabling auto-docking functionality, communicating with each robot, as well as features for network and/or Bluetooth connectivity.

The dishwasher 830 includes a wash chamber 834 provided with a sump 836 at a lower part of the wash chamber 834. During operation of the dishwasher 830, water sprayed on dishes in the wash chamber 834 flows downwardly and collects in the sump 836. A pump 840 is provided in fluid communication with the sump 836 for directing liquid in the sump 836 to a drain line 842. A separate wash pump (not shown) can be provided for recirculating liquid in the sump 836 back into the wash chamber 834, or the pump 840 shown in FIG. 12 may be a combination wash/drain pump which can direct liquid either to the drain line 842 or the wash chamber 834.

The disposal system 800 can include the dishwasher pump 840, a waste receiver coupling 815 on a housing or cabinet of the dishwasher 830 that is configured to mate or otherwise couple with a corresponding waste disposal coupling 136 on the robot 100, and an evacuation conduit 876 in fluid communication with the waste receiver coupling 815. The docking station 810 of the dishwasher 830, particularly the waste receiver coupling 815, can be provided at a front side of the dishwasher 830, such as below a door 832 of the dishwasher 830 or adjacent to the dishwasher 830 in a cabinet toe kick 835. The waste disposal coupling 136 on the robot 100 is in fluid communication with the robot recovery tank 118, such that waste collected by the recovery tank 118 can be disposed of by the disposal system via the docked or mated couplings 136, 815. The evacuation conduit 876 has an outlet end fluidly coupled to the inlet side of the pump 840. The evacuation conduit 876 can be vacuum pressurized by the pump 840 and can carry waste from the recovery tank 118 to the pump 840, and on to the drain line 842, also pressurized by the pump 840.

As shown, the drain line 842 can be fluidly coupled with a garbage disposal 852 associated with a sink 850. The drain line 842 thereby carries waste from the recovery tank 118 to the garbage disposal 852. The outlet of the garbage disposal 852 is fluidly coupled with a trap 854. The trap 854 may be fluidly coupled with a septic tank or a system connected to a sewage treatment plant.

Optionally, one or more additional conduits (not shown) can fluidly couple the components of the robot 100 together and/or the components of the docking station 810 or dishwasher 830 together. Alternatively, for the robot 100, the waste disposal coupling 136 can be provided directly on the recovery tank 118 and can be configured to close an outlet of the recovery tank 118 when the robot 100 is not docked with the docking station 810 and further be configured to open the outlet of the recovery tank 118 when the robot 100 is docked with the docking station 810.

Figure 13:
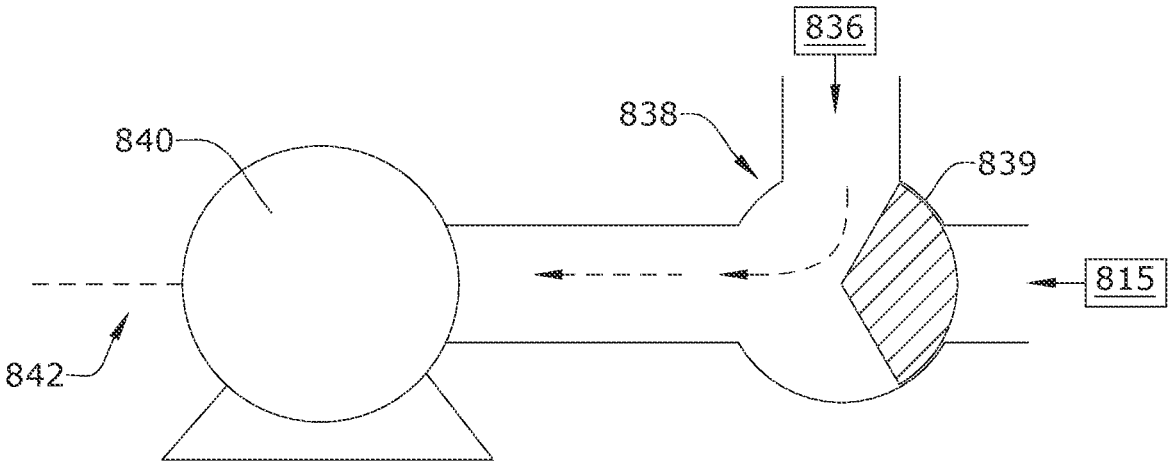
FIG. 13 is a schematic view of a diverter valve for the system of FIG. 12 in a first position.
Figure 14:
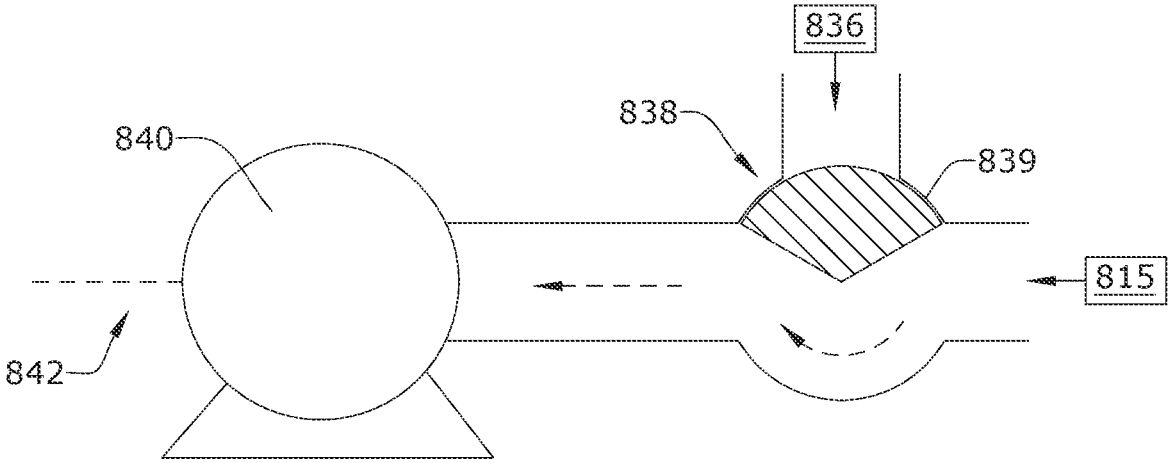
FIG. 14 is a schematic view of the diverter valve of FIG. 13 in a second position.

The disposal system can be optionally provided with a diverter valve 838 configured to divert the fluid pathway to the dishwasher pump 840 between either of the dishwasher sump 836 and the robot 100. In one example, shown in FIGS. 13-14, the diverter valve 838 can include a rotatable valve body 839 that is movable between at least a first position shown in FIG. 13 in which the sump 836 is in fluid communication with the pump 840 and a second position shown in FIG. 14 in which the waste receiver coupling 815 of the docking station 810 is in fluid communication with the pump 840. When the robot 100 docks with the docking station 810, the diverter valve 838 can automatically move to the second position shown in FIG. 14.

In operation, in a successful docking between the robot 100 and the docking station 810, the waste disposal coupling 136 on the robot mates or otherwise fluidly couples with the waste receiver coupling 815 of the docking station 810. Next, the dishwasher pump 840 energizes and creates suction to draw waste from the recovery tank 118 through the evacuation conduit 876, and into the drain line 842 of the dishwasher 830.

The dishwasher pump 840 can be automatically energized upon a successful docking between the robot 100 and the docking station 810. In one example, once the robot 100 docks successfully, an emptying cycle or mode of operation can be initiated. Prior to initiation of the emptying mode, the robot 100 can send a confirmation signal to the docking station 810 indicating that the robot 100 has successfully docked and is ready to commence emptying. For example, an RF signal can be sent from the robot 100 to the docking station 810, and back to the robot 100. Alternatively, a pulsed signal can be sent through the charging pathway between the charging contacts for the battery pack 152 (FIG. 2) and the docking station 810. As yet another alternative, an IR signal can be sent to be robot 100 to an IR receiver on the docking station 810. As yet another alternative the robot 100 can communicate with the docking station 810 via an electrical signal through the mated waste receiver and waste supply couplings 815, 136.

The emptying mode is preferably automatically initiated after the confirmation signal is sent. The emptying mode can be controlled by a controller on the docking station 810 or by a controller on the dishwasher 830, and automatically initiates once the robot 100 is confirmed to be docked in the docking station 810. The initiation of the emptying mode may be automatically delayed if the dishwasher 830 is performing a dishwashing cycle when the robot 100 docks.

Alternatively, the emptying mode can be manually initiated, with the user initiating the emptying mode by pressing a button on the user interface 124 (FIG. 2). Manual initiation of the emptying mode may be preferred when the dishwasher 830 is in use when the robot 100 returns to the docking station 810 and the user would prefer to delay the emptying mode, such as when the dishwasher 830 is being loaded or unloaded, or when the dishwasher 830 is performing a dishwashing cycle. The button on the user interface 124 can be configured to both pause and re-initiate the emptying mode. The emptying mode may be locked-out by the controller 128 on the robot 100 when the robot 100 is not docked to prevent inadvertent initiation of the emptying mode.

The dishwasher pump 840 may be automatically de-energized when the robot 100 recovery tank 118 is empty. For example, the recovery tank 118 can be provided with a level sensor that communicates with a controller on the docking station 810 or dishwasher 830 when the recovery tank 118 is empty and emptying is complete.

It is noted that while the dishwasher 830 of the illustrated embodiment is shown as draining via a garbage disposal 852, this is not required in all embodiments of the system 800, and in other examples the drain line 842 can drain to another line, such as directly to the sink 850 drain pipe or trap 854. It is also noted that the system 800 can include an air gap (not shown) to prevent the back flow of liquid into the dishwasher 830.

While the system 800 is shown with a dishwasher 830 having the docking station 810 for the robot 100, it is understood that the systems of any of the embodiments shown herein can have a docking station for the robot 100 provided on another appliance. Some non-limiting examples of appliances in addition to a dishwasher 830 include a refrigerator, a washing machine, a humidifier, and a clothes dryer.

Figure 15:
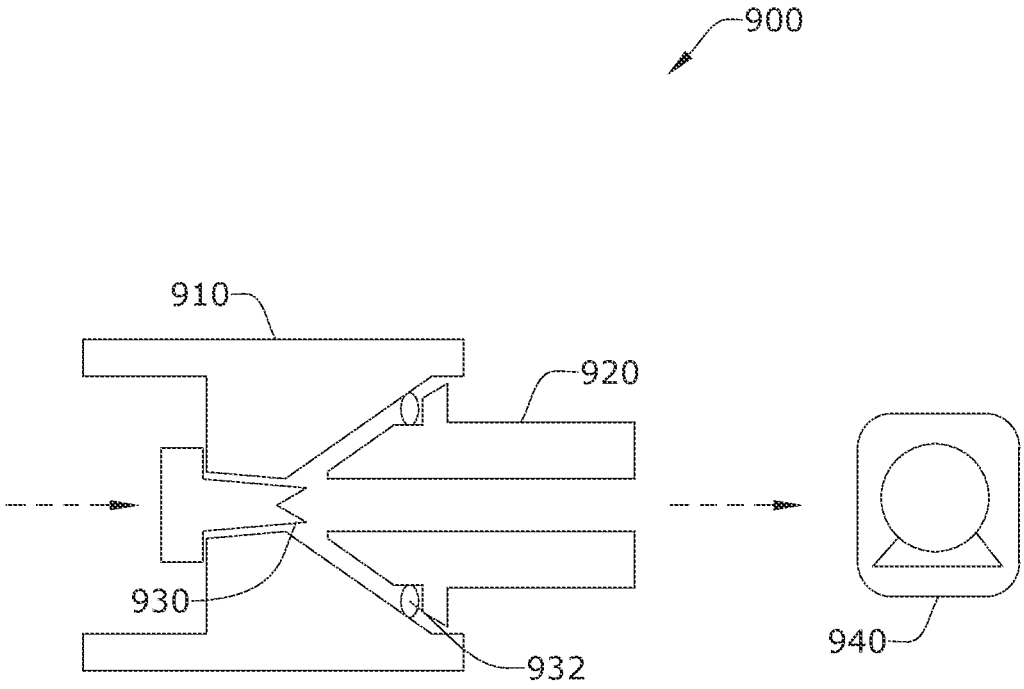
FIG. 15 is a schematic view of one embodiment of a fluid coupling assembly for the systems disclosed herein.
Figure 16:
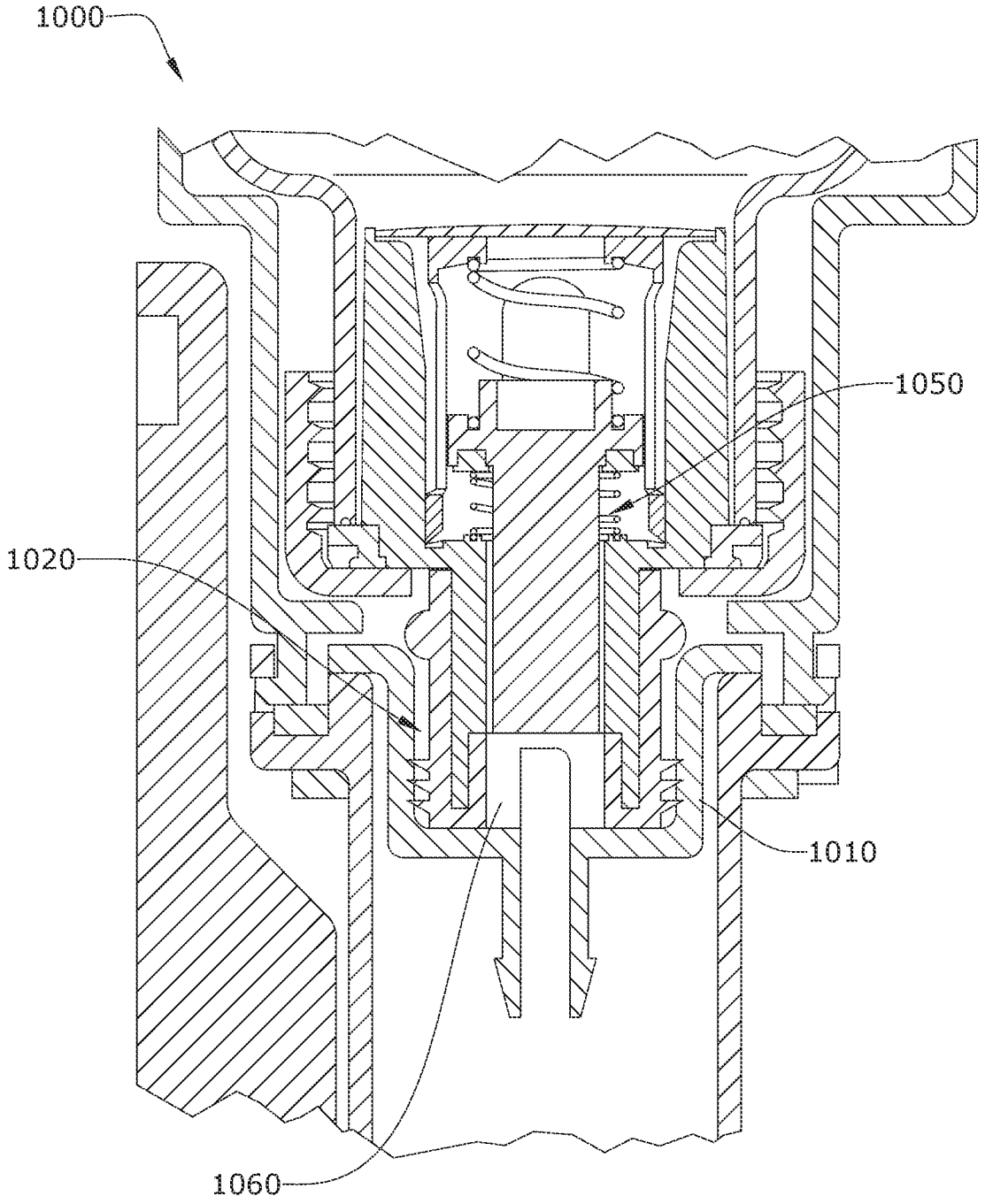
FIG. 16 is a schematic view of another embodiment of a fluid coupling assembly for the systems disclosed herein.

In the exemplary docking stations 10, 210, 310, 410, 510, 810 described herein, fluid couplings on the robot 100 and the docking stations 10, 210, 310, 410, 510, 810 mate when the robot 100 is docked in the docking station 10, 210, 310, 410, 510, 810 to direct liquid between the robot 100 and docking station 10, 210, 310, 410, 510, 810. For example, the liquid supply system of the exemplary docking stations 10, 210, 310 described herein include a water supply coupling on a housing of the docking station configured to mate or otherwise couple with the corresponding water receiver coupling 132 on the robot 100, and the disposal system of the exemplary docking stations 410, 510, 810 described herein include a waste receiver coupling on a housing of the docking station configured to mate or otherwise couple with the corresponding waste disposal coupling 136 on the robot 100. FIGS. 15-16 show some non-limiting embodiments of fluid coupling assemblies that can be used for the fluid couplings described herein.

In FIG. 15, a fluid coupling assembly 900 includes a male coupling 920 configured to mate or otherwise couple with a corresponding female coupling 910. The female coupling 910 includes a check valve 930 that is normally closed. When the male coupling 920 is received by the female coupling 910 and negative pressure is applied, such as by a pump, which can include a fill pump of a liquid supply system or a disposal pump of a disposal system, the check valve 930 opens and liquid can flow through the mated couplings 910, 920. The check valve 930 can be a one-way check valve, such as a duckbill valve.

Optionally, a seal 932 is provided at the interface between the male and female couplings 920, 910 to prevent liquid from escaping from the fluid coupling assembly 900. Negative pressure applied by the pump 940 can also reinforce the seal 932 between the male and female couplings 920, 910.

Depending on whether the fluid coupling assembly 900 is used for a liquid supply system or disposal system, of the docking station, the female receiver, or female coupling 910, can be provided on the docking station 10 (FIG. 1) or on the robot 100. In general, the female receiver 910 is provided on the unit providing liquid and the male receiver, or male coupling 920, is provided on the unit receiving liquid, i.e. the unit that comprises a pump. For example, in the case where the liquid fluid coupling assembly 900 is used for a liquid supply system, such as the system 8, the female coupling 910 can be located on the docking station 10 and the male coupling 920 can be located on the robot 100. In the case where the liquid fluid coupling assembly 900 is used for a disposal system, such as the system 409, the female coupling 910 can be located on the robot 100 and the male coupling 920 can be located on the docking station 410.

In FIG. 16, a fluid coupling assembly 1000 includes a male coupling 1020 configured to mate or otherwise couple with a corresponding female coupling 1010. The male coupling 1020 includes a spring-loaded valve 1050 that is normally closed. When the male coupling 1020 is received by the female coupling 1010, the spring-loaded valve 1050 is opened by a mechanical valve actuator 1060 provided on the female coupling 1010, and liquid can flow through the mated couplings 1010, 1020. The valve actuator 1060 can define a portion of a fluid flow conduit through the female coupling 1010. With this fluid coupling assembly 1000, the female receiver, or female coupling 1010, can be provided on the docking station or on the robot, and the male receiver, or male coupling 1020, can be provided on the other of the docking station or on the robot, regardless of which unit is providing liquid and which unit is receiving liquid.

Figure 17:
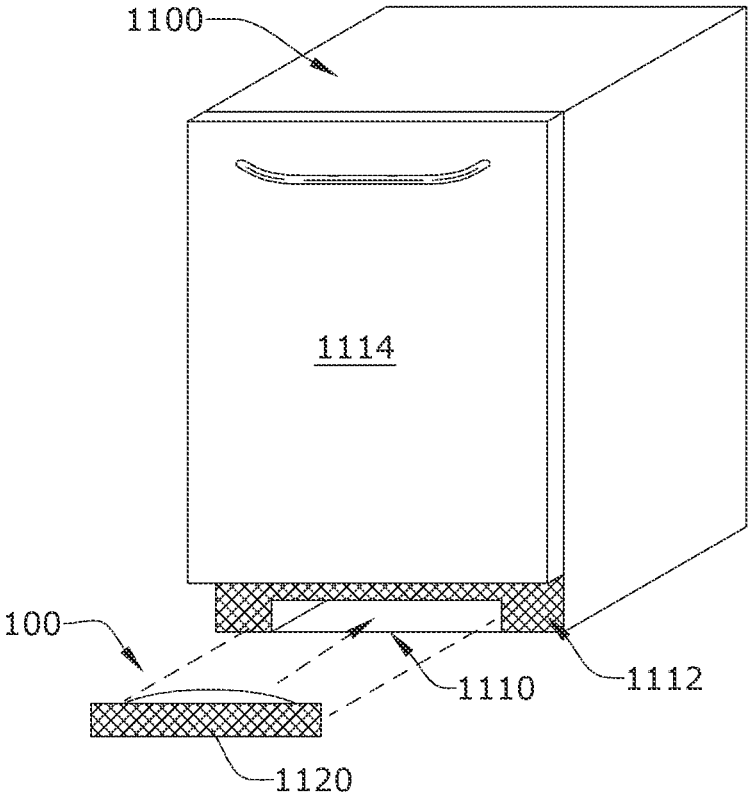
FIG. 17 is a schematic view of one embodiment of a system in which a deep cleaning robot is configured to blend into a user's home.

With reference to FIGS. 17-20, the docking station disclosed in any embodiment of the present disclosure can be built into the toilet, dishwasher, or other household appliance, or retrofitted to an existing toilet, dishwasher, or other household appliance. The robot 100 for use with the systems of the present embodiment can be designed to blend into the bathroom or kitchen of the user's home. Turning to FIG. 17, for example, the robot 100 can include a trim piece 1120 or decorative panel that matches the area of the toilet or dishwasher or the cabinetry surrounding the docking station for an integrated appearance. In the illustrated example, the robot 100 and a docking station 1110 can be configured to match a toe kick 1112 or bottom of a dishwasher 1100. In another example, for a retrofitted docking station for a dishwasher, an after-market kit can be provided where the user cuts the toe kick 1112 off their dishwasher 1100 and applies it to the robot 100. Other kits could come with a range of laminate panels to match or contrast the cabinets surrounding the docking station 1110. Alternative examples can incorporate the docking station 10 for a robot vacuum 100 into plant stands, lamp tables, or other furniture in the home for concealing the robot when not in use.

The docking station 1110 can be provided at a front lower side of the household appliance 1100, which can include a door 1114, such that a deep cleaning robot 100 can drive up to the household appliance 1100 and dock with the docking station 1110. The household appliance may include, but is not limited to, a dishwasher, refrigerator, washing machine, humidifier or clothes dryer. For illustrative purposes, the household appliance 1100 is shown as a dishwasher, and the docking station is provided below the door 1114 of the dishwasher.

Figure 18:
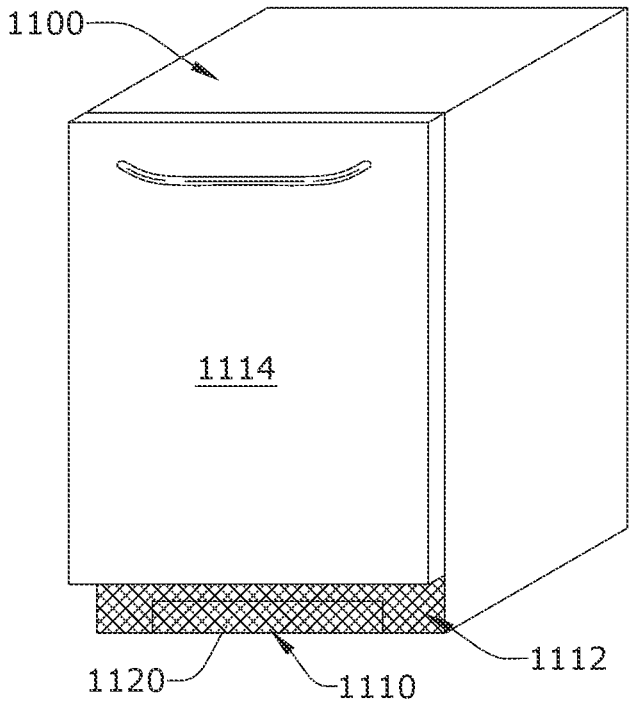
FIG. 18 is a schematic view of the system of FIG. 17 where the deep cleaning robot is blended into a user's home.

The deep cleaning robot 100 is provided with a trim piece 1120 that matches the area of the appliance surrounding the docking station. For example, the trim piece 1120 may match the material, color, and finish of an appliance panel, grill, toe kick 1112 or other component. The trim piece 1120 can additionally or alternatively match the shape of the docking station 1110 such that when the robot 100 docks with the docking station 1110, as shown in FIG. 18, the trim piece 1120 can mate with or join the appliance 1100 for a seamless or near-seamless visual appearance, with matching or contrasting material, color, and finish.

The deep cleaning robot 100 can be provided with the trim piece 1120 by the manufacturer, or after-market kits can be provided to let users select a suitable trim piece 1120 and to apply it to the robot 100. In one non-limiting example, the deep cleaning robot 100 can have an overall D-shape, with a flat wall. The trim piece 1120 can be provided on the flat wall of the robot 100.

Figure 19:
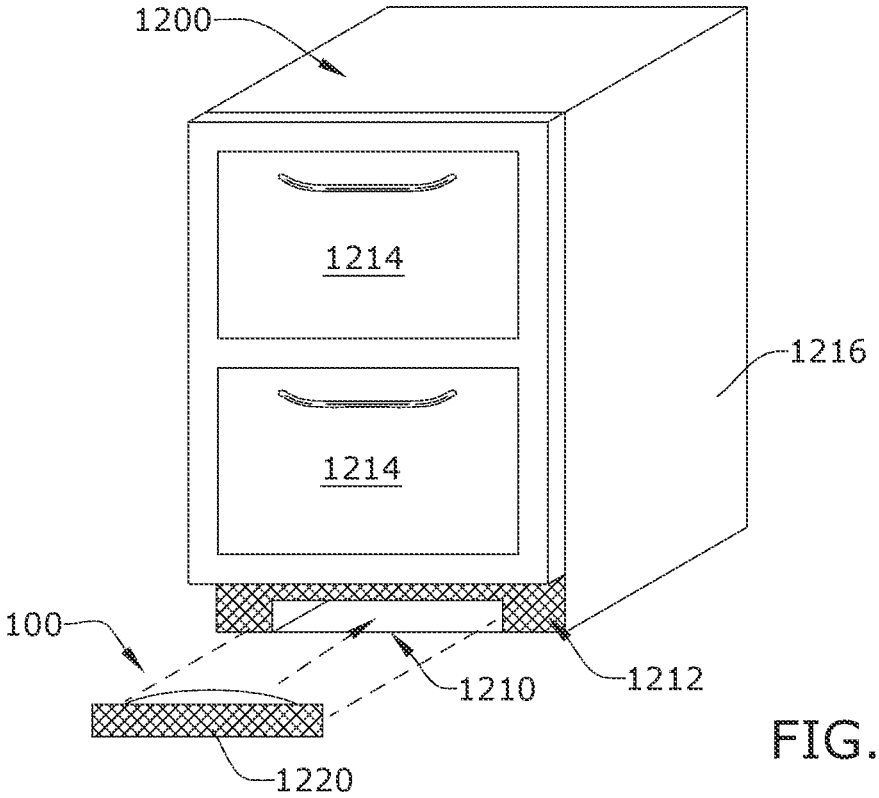
FIG. 19 is a schematic view of another embodiment of a system in which a deep cleaning robot is configured to blend into a user's home.
Figure 20:
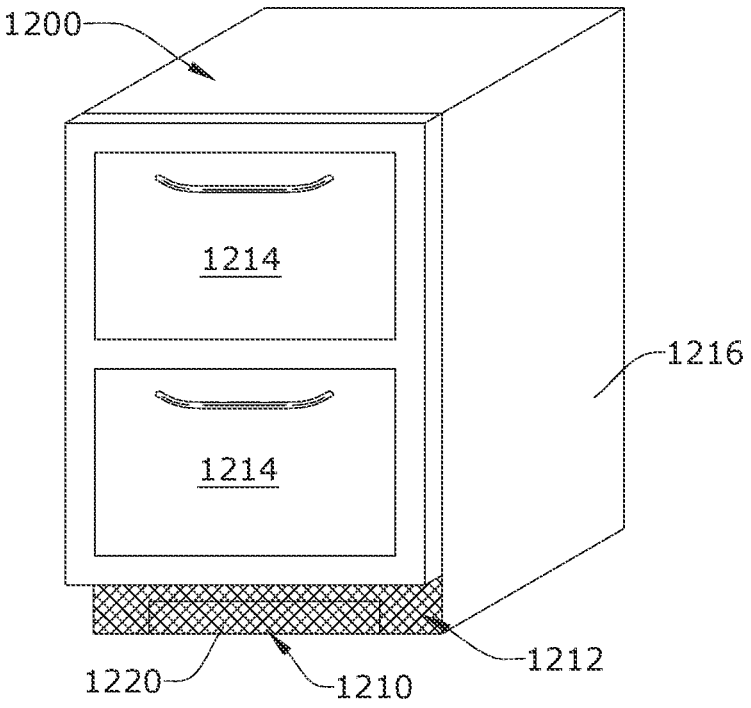
FIG. 20 is a schematic view of the system of FIG. 19 where the deep cleaning robot is blended into a user's home.

In FIGS. 19-20, a docking station 1210, which can be a docking station according to any embodiment described herein, is provided at a front lower side of household cabinetry including at least one cabinet 1200, such that a deep cleaning robot 100 can drive up to the cabinet 1200 and dock with the docking station 1210. The household cabinetry can include, but is not limited to, cabinetry in a bathroom, kitchen, laundry room, or mudroom. For illustrative purposes, the docking station 1210 is provided in a toe kick 1212 of the cabinet 1200, below a drawer 1214 of the cabinet 1200; alternative locations include below a door, in a door or drawer 1214 of the cabinet 1200, in a sidewall 1216 of the cabinet 1200.

The deep cleaning robot 100 can be provided with a trim piece 1220 that matches the area of the cabinet 1200 surrounding the docking station 1210. For example, the trim piece 1220 may match the material, color, and finish of the cabinet toe kick 1212, drawer 1214, or sidewall 1216. The trim piece 1220 can additionally or alternatively match the shape of the docking station 1210 such that when the robot 100 docks with the docking station 1210, as shown in FIG. 20, the trim piece 1220 can mate with or join the cabinet 1200 for a seamless or near-seamless visual appearance, with matching or contrasting material, color, and finish.

The deep cleaning robot can be provided with the trim piece 1220 by the manufacturer, or after-market kits can be provided to let users select a suitable trim piece 1220 and to apply it to the robot 100. Other kits could come with a range of trim piece panels to match or contrast the cabinet 1200. In one non-limiting example, the deep cleaning robot 100 can have an overall D-shape, with a flat wall. The trim piece 1220 can be provided on the flat wall of the robot 100.

There are several advantages of the present disclosure arising from the various features of the apparatuses described herein. For example, the embodiments of the invention described above provides automated filling and emptying of an autonomous deep cleaning robot. Deep cleaners currently available must be manually filled and emptied by the user, sometimes more than once during a cleaning operation if cleaning an area larger than the capacity of the tanks. The automated supply and disposal system disclosed in the embodiment herein offer long term automation of a cleaning operation that includes automation of the emptying and refilling operations, which will allow cleaning to continue without requiring interaction by or even the presence of the user.

Another advantage of some embodiments of the present disclosure is that the system leverages the existing infrastructure already found in most homes and other buildings, and uses a toilet to supply cleaning fluid to, evacuate waste from, and/or recharge the battery of a deep cleaning robot.

Yet another advantage of some embodiments of the present disclosure is that the system leverages the existing infrastructure already found in most homes and other buildings, and uses a dishwasher to evacuate waste from a deep cleaning robot.

It is further noted that the docking station disclosed in any embodiment of the present disclosure can be built into the toilet, dishwasher, or other household appliance, or retrofitted to an existing toilet, dishwasher, or other household appliance. Users try to find places to hide their autonomous cleaners with limited success. Autonomous cleaners and their charging stations need to be accessible to the space being cleaned. This combination is often unsightly and cumbersome to step over. Aspects of the present disclosure offer a solution to at least partially hide the robot away when not being used and takes up space that is usually not utilized.

While various embodiments illustrated herein show an autonomous or robotic cleaner, aspects of the invention such as the supply and disposal docking station may be used on other types floor cleaners having liquid supply and extraction systems, including non-autonomous cleaners. Still further, aspects of the present disclosure may also be used on surface cleaning apparatus other than deep cleaners, such as an apparatus configured to deliver steam rather than liquid.

To the extent not already described, the different features and structures of the various embodiments disclosed herein may be used in combination with each other as desired. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible with the scope of the foregoing disclosure and drawings without departing from the spirit of the invention which, is defined in the appended claims. Hence, specific dimensions and other physical characteristics relating to the embodiments disclosed herein are not to be considered as limiting, unless the claims expressly state otherwise.

What is claimed is:

1. A system, comprising:

a docking station for docking an autonomous floor cleaner, the docking station comprising:

a liquid supply system configured to provide liquid to the autonomous floor cleaner, the liquid supply system comprising a supply conduit;

a reservoir refill valve;

a float coupled with the reservoir refill valve; and an intermediate reservoir fluidly coupled to the liquid supply system via the reservoir refill valve, wherein the float is configured to close the reservoir refill valve when a liquid level in the intermediate reservoir rises to a predetermined level, and to open the reservoir refill valve when the liquid level in the intermediate reservoir drops below the predetermined level;

wherein the docking station is configured to be fluidly coupled to a plumbing infrastructure; and wherein the liquid supply system is configured to automatically provide liquid to the autonomous floor cleaner.

2. The system of claim 1, wherein the liquid supply system further comprises a shut-off valve configured for closing a fluid pathway when the autonomous floor cleaner is not docked with the docking station.

3. The system of claim 2 wherein the shut-off valve is operated automatically upon docking of the autonomous floor cleaner with the docking station.

4. The system of claim 3, wherein the docking station is communicatively coupled with the autonomous floor cleaner and configured to determine docking and/or receive a docking signal.

5. The system of claim 2, further comprising a seal provided at an interface between the shut-off valve and the supply conduit to prevent liquid from escaping.

6. The system of claim 2, wherein the docking station further comprises a disposal system configured to empty a recovery tank onboard the autonomous floor cleaner and comprising a waste receiver coupling configured to couple with a corresponding waste disposal coupling on the autonomous floor cleaner.

7. The system of claim 6, wherein the docking station is configured to empty the recovery tank via the plumbing infrastructure and/or the liquid supply system is further configured to fill a supply tank onboard the autonomous floor cleaner and further comprises a supply coupling configured to couple with a corresponding receiver coupling on the autonomous floor cleaner.

8. The system of claim 7, further comprising an autonomous floor cleaner comprising an autonomously moveable housing and a drive system for autonomously moving the autonomous floor cleaner.

9. The system of claim 8, wherein the autonomous floor cleaner comprises an agitator and/or a fill pump for drawing liquid into a supply tank from the docking station.

10. The system of claim 1, wherein the docking station further comprises a disposal system configured to empty a recovery tank onboard the autonomous floor cleaner and comprising a waste receiver coupling configured to couple with a corresponding waste disposal coupling on the autonomous floor cleaner.

11. The system of claim 10, wherein the docking station is configured to empty the recovery tank via the plumbing infrastructure and/or the liquid supply system is further configured to fill a supply tank onboard the autonomous floor cleaner and further comprises a supply coupling configured to couple with a corresponding receiver coupling on the autonomous floor cleaner.

12. The system of claim 11, further comprising an autonomous floor cleaner comprising an autonomously moveable housing and a drive system for autonomously moving the autonomous floor cleaner and wherein the autonomous floor cleaner comprises an agitator and/or a fill pump for drawing liquid into a supply tank from the docking station.

13. The system of claim 10, wherein the docking station comprises a power cord, and the docking station is configured to be connected to a power supply by the power cord, wherein the docking station further comprises a charging system configured to recharge the autonomous floor cleaner and the autonomous floor cleaner comprises a battery pack.

14. The system of claim 1, further comprising an autonomous floor cleaner comprising an autonomously moveable housing and a drive system for autonomously moving the autonomous floor cleaner.

15. The system of claim 14 wherein the autonomous floor cleaner comprises an agitator and/or a fill pump for drawing liquid into a supply tank from the docking station.

16. The system of claim 1, wherein the docking station comprises a power cord, and the docking station is configured to be connected to a power supply by the power cord, wherein the docking station further comprises a charging system configured to recharge the autonomous floor cleaner and the autonomous floor cleaner comprises a battery pack.

17. The system of claim 1, wherein the liquid supply system is further configured to fill a supply tank onboard the autonomous floor cleaner and further comprises a supply coupling configured to couple with a corresponding receiver coupling on the autonomous floor cleaner.

18. The system of claim 1, further comprising a float rod, wherein the float rod is configured to press against the reservoir refill valve to thereby close the reservoir refill valve when the intermediate reservoir is full.

* * * * *